US011337494B2

(12) United States Patent
Fridman et al.

(10) Patent No.: US 11,337,494 B2
(45) Date of Patent: May 24, 2022

(54) SLIDE FASTENER

(71) Applicant: ZIP IT LTD., Tel Aviv (IL)

(72) Inventors: Felix Fridman, Holon (IL); David Moshe Bortz, Tel Aviv (IL); Itamar Cohen, Karmei Yosef (IL)

(73) Assignee: ZIP IT LTD., Tel Aviv (IL)

( * ) Notice: Subject to any disclaimer, the term of this patent is extended or adjusted under 35 U.S.C. 154(b) by 2 days.

(21) Appl. No.: 16/960,365

(22) PCT Filed: Jan. 21, 2019

(86) PCT No.: PCT/IL2019/050079
§ 371 (c)(1),
(2) Date: Jul. 7, 2020

(87) PCT Pub. No.: WO2019/145940
PCT Pub. Date: Aug. 1, 2019

(65) Prior Publication Data

US 2021/0052044 A1 Feb. 25, 2021

(30) Foreign Application Priority Data

Jan. 23, 2018 (IL) ..... 257095

(51) Int. Cl.
*A44B 19/26* (2006.01)
*A44B 19/34* (2006.01)

(52) U.S. Cl.
CPC ..... *A44B 19/262* (2013.01); *A44B 19/34* (2013.01)

(58) Field of Classification Search
CPC ..... A44B 19/262; A44B 19/34; A44B 19/36
See application file for complete search history.

(56) References Cited

U.S. PATENT DOCUMENTS

| | | | | |
|---|---|---|---|---|
| 1,219,881 | A | 3/1917 | Sundback | |
| 7,304,600 | B2 | 12/2007 | Nehls et al. | |
| 8,402,613 | B2 | 3/2013 | Williams et al. | |
| 8,528,115 | B2 | 9/2013 | Damon et al. | |
| 8,832,909 | B2 | 9/2014 | Takani | |
| 2002/0038496 | A1 | 4/2002 | Yamagishi et al. | |
| 2002/0133917 | A1* | 9/2002 | Chu | A44B 19/262 24/429 |
| 2003/0177616 | A1 | 9/2003 | Petravic et al. | |

(Continued)

FOREIGN PATENT DOCUMENTS

| | | | |
|---|---|---|---|
| DE | 202016100260 | U1 | 2/2016 |
| DE | 202017106962 | U | 12/2017 |

(Continued)

*Primary Examiner* — David M Upchurch
(74) *Attorney, Agent, or Firm* — Dorsey & Whitney LLP

(57) ABSTRACT

A zipper assembly including a left side tape configured with a plurality of left fastener teeth, and a right side tape configured with a plurality of right fastener teeth, defining together a zipper path, and at least one primary slider member slidingly displaceable along the zipper path for interlocking engagement or disengagement of left fastener teeth with corresponding right fastener teeth, wherein at least a portion of the zipper path is configured with a raceway extending through alternating neighboring left fastener teeth and right fastener teeth, said raceway configured for slidingly accommodating a flexible strip articulated at a first end thereof to the at least one slider member.

20 Claims, 26 Drawing Sheets

(56) References Cited

U.S. PATENT DOCUMENTS

| | | | | |
|---|---|---|---|---|
| 2004/0103502 | A1 | 6/2004 | Chen et al. | |
| 2006/0164280 | A1* | 7/2006 | Nehls | G08C 17/02 341/176 |
| 2007/0094852 | A1* | 5/2007 | Wang | A44B 19/32 24/389 |
| 2011/0198175 | A1* | 8/2011 | Chiang | A44B 19/34 190/119 |
| 2016/0015133 | A1* | 1/2016 | Chung | A44B 19/403 24/411 |
| 2017/0150789 | A1 | 6/2017 | Lin | |

FOREIGN PATENT DOCUMENTS

| | | | |
|---|---|---|---|
| GB | 2485968 | A | 6/2012 |
| JP | 2014500769 | A | 1/2014 |
| KR | 840000889 | B1 | 6/1984 |
| TW | M322751 | U | 12/2007 |
| TW | 201438619 | A | 10/2014 |
| WO | 2015190917 | A1 | 12/2015 |

* cited by examiner

SLIDE FASTENER

BACKGROUND

Technological Field

The present disclosure is concerned with a zipper-type slide fastener.

Background Art

References considered to be relevant as background to the presently disclosed subject matter are the following: U.S. Pat. Nos. 1,219,881; 8,402,613; 7,304,600; and 8,832,909.

Acknowledgement of the above references herein is not to be inferred as meaning that these are in any way relevant to the patentability of the presently disclosed subject matter.

Zippers are well known in the art. The first 'modern' zipper was patented back in 1917, granted for a 'separable fastener'. It was only later at about 1937 that zippers became widely used by fashion designers, U.S. Pat. No. 1,219,881 is directed to a fastener comprising a pair of flexible stringers, interlocking members secured at one end thereto in staggered relation, each member having at the free end a transversely elongated rounded recess on one side and a transversally elongated rounded projection on the opposite side, the recessed side and the transversal elongated end surface of the edge member meeting in an edge and constituting guiding means enabling said members to ride one on the other in interlocking.

U.S. Pat. No. 8,402,613 is directed to a slide fastener, comprising: a pair of fastener tapes each comprising a tape layer; a pair of coupling elements provided along adjacent edges of the pair of fastener tapes; a slider that engages or separates the pair of coupling elements with or from each other; and an end stop secured to the pair of fastener tapes at an end portion of the pair of coupling elements, wherein the pair of coupling elements are integrally secured to each other at one region of the end portion of the pair of coupling elements, wherein the one region extends between a rear end portion of a diamond of the slider and a base portion of the slider in a state where the base portion of the slider comes in contact with the end stop, wherein the slide fastener is a waterproof slide fastener, wherein each of the tape layers comprises at least one waterproof layer, wherein the waterproof layers abut one another, wherein the abutting waterproof layers are further melted and welded, and wherein an extension portion of the end stop is formed where the abutting waterproof layers are melted and welded U.S. Pat. No. 7,304,600 discloses a wireless remote control device for transmitting control commands to a Bluetooth™ enabled electronic device, such as a television set, an audio player, or a cellular telephone by manipulating the zipper in a garment, handbag or the like. The zipper fastener consists of opposing rows of interlocking teeth attached to a pair of elongated flexible supports and a manually movable sliding traveler that locks and unlocks said teeth at it moves longitudinally along the length of said flexible supports. A sensor is coupled to said zipper fastener for generating a position signal that indicates the current position of said sliding traveler with respect to said supports, and a Bluetooth™ transmitter coupled to said sensor sends control commands indicative of the current position of the slider and the state of a pushbutton attached to the slider.

U.S. Pat. No. 8,832,909 discloses a slide fastener for preventing core strings from being caught in a gap between upper and lower flanges, securing the flexibility of the slide fastener when engaged, and improving the designability of the slide fastener. The gap dimension between the upper and lower flanges of a slider in the up-down direction is smaller than the core string dimension in the front-rear direction when the core strings are pressed with the pressure of 5 kgf. Fastener elements are independently disposed in the up-down direction of a tape member when engaged. The fastener element has a design portion disposed at a front side of the tape member, and an engaging portion disposed at a rear side of the tape member so as to engage with adjacent fastener element, and the design portion is disposed distant from the adjacent design portion when engaged and having a hemispherical shape with a curved shape.

GENERAL DESCRIPTION

According to the present disclosure there is disclosed a zipper assembly comprising a zipper path with at least one primary slider member and at least one secondary motion mechanism, and a flexible strip articulated at a first end thereof to said slider member and at a second end to said secondary motion mechanism; whereby displacement of one of the slider member and the secondary motion mechanism entails reactionary motion of at least the other one of the slider member and the secondary motion mechanism.

The term strip as used herein in the specification and claims denotes any form of long, narrow piece of a material, in any shape and made of any material. The strip can be cord-like (cylindrical) or strap-like (flat), have a solid or hollow cross section, and it can be made of homogenous material such as synthetic material, fabric, metal, etc., or composite material.

According to the present disclosure there is provided a zipper assembly comprising a left side tape configured with a plurality of left fastener teeth, and a right side tape configured with a plurality of right fastener teeth, defining together a zipper path, and at least one primary slider member slidingly displaceable along the zipper path for interlocking engagement or disengagement of left fastener teeth with corresponding right fastener teeth, wherein at least a portion of the zipper path is configured with a raceway extending through alternating neighboring left fastener teeth and right fastener teeth, said raceway slidingly accommodating a flexible strip articulated at a first end thereof to the at least one slider member.

The terms engaged and disengaged represent so-called closed and open position of the zipper path, respectively.

A second end of the flexible strip can be articulated to a secondary motion mechanism. The second end can extend within or outside the zipper path. The second end of the flexible strip can be loose, or it can be articulated to a manipulating device configured for pulling/pushing the flexible strip through the raceway.

The raceway extending through alternating neighboring left fastener teeth and right fastener teeth may be configured by a plurality of coextending recesses formed in successive alternating left fastener teeth and mating right fastener teeth. The recesses may have a generally U-like shape, with the opening facing away from the respective carrying tape.

Any one or more of the following features, designs and configurations can be applied to a zipper assembly according to the present disclosure, independently or in various combinations thereof:

The primary slider member is displaceable only along the zipper path, whilst reactionary motion of the secondary motion mechanism can be axial or rotary motion;

The flexible strip can be stiff yet pliable, and can thus be used for pulling and for pushing of the respective primary slider member and the secondary motion mechanism. Such flexible strips will not collapse upon pushing, and can be made of metal, composite material, etc.; an example of such a flexible strip is a wire.

The flexible strip can be a single thread or a cord consisting of several threads binned together, suitable only for pulling of the respective slider member and the secondary motion mechanism;

The first end of the strip member can be fixedly articulated to a body portion of the primary slider member;

The first end of the strip member can be slidingly articulated to a body portion of the primary slider member, wherein displacing the primary slider body along the zipper path results in respective engagement or disengagement of left fastener teeth with corresponding right fastener teeth, however without displacing the flexible strip and therefore without effecting the secondary motion mechanism; and wherein displacing the secondary motion mechanism imparts linear motion to the flexible strip and to the primary slider member, respectively;

the raceway is substantially symmetrically disposed along a central longitudinal axis of the zipper assembly;

the raceway is configured to be closed when the zipper path is closed, i.e. when left fastener teeth are engaged with corresponding right fastener teeth, and the raceway is configured to be open when the zipper path is open, i.e. when left fastener teeth are disengaged from corresponding right fastener teeth, respectively;

The zipper assembly can be configured to generate an electric signal generated by linear or rotary potentiometer associated with the at least one primary slider member or the secondary motion mechanism;

The zipper teeth can be of any type, namely Vision® zipper (made of injection molded plastic elements set to the zipper tape at regular intervals), or as a metal zipper (comprising multiple pieces of metal teeth secured to the zipper tape at regular intervals), or as a coil zipper (made of spiral plastic elements articulated to the zipper tape, wherein each thread functions as a zipper tooth);

The raceway extending through alternating neighboring left fastener teeth and right fastener teeth can comprise a right raceway portion extending through consecutive one of the right fastener teeth and a complementary a left raceway portion, extending through consecutive one of the left fastener teeth;

The right raceway portion and the left raceway portion can be symmetric or asymmetric;

The zipper assembly can comprise two (or more) parallelly extending raceways, each slidingly accommodating a flexible strip; the sliding strips can act in the same direction or in opposite directions with consequent reactionary motion of the at least one primary slider member and the secondary motion mechanism;

Each of the at least one primary slider member and the secondary motion mechanism can be manipulable at either one or both faces of the zipper path;

The right fastener teeth and the left fastener teeth constituting part of the raceway are configured with a substantially U-like shaped recess with an opening facing respective opposite fastener teeth;

The raceway can extend along the entire length of the zipper assembly or along one or more selected portions thereof;

The zipper path of the zipper assembly can comprise one or more segments, each associated with a primary slider member; the primary slider member of one of the one or more segments can be articulated to a primary slider member or to a secondary motion mechanism of another one of the one or more segments, through a flexible strip articulated thereto;

The at least one primary slider member can comprise a body member slidingly displaceable over the zipper path, said body member comprising a diamond element configured for separating engaged left fastener teeth from corresponding right fastener teeth, and wherein the flexible strip is articulated to said diamond element;

The zipper assembly can be of any configuration, such as a closed-end zipper system, an open-end zipper system, a two-way open-end zipper system, a two way closed-end zipper system (so called head to head configuration), and a two way closed-end X type zipper system (so called bottom to bottom configuration);

The secondary motion mechanism can be a second zipper slider, of any type and disposed at either head to head or bottom to bottom relation with respect to the primary slider member;

The secondary motion mechanism can be a retraction mechanism wherein the flexible strip is biased by the retraction mechanism to exert pulling force to the primary slider member;

The secondary motion mechanism can be associated with a cord retractor for reducing force required for displacing the flexible strip through the raceway;

The cord retractor can comprise a deployable flexible strip, which in turn can be articulated directly to the primary slider member, or via a secondary motion mechanism;

The secondary motion mechanism can be a secondary slider member;

The secondary slider member can be disposed over the zipper path at back to back, or front to front, or back to front orientation, respective to the primary slider member;

A cord retractor associated with the zipper assembly can be motorized or energized (biased) so as to exert pulling/pushing force to the flexible strip;

The flexible strip can extend through a bottom stop of the zipper assembly;

The flexible strip can extend through a retaining box of the zipper assembly;

The flexible strip can be fixedly articulated to one or both of the primary slider member and the secondary motion mechanism;

The flexible strip can be detachably articulated to one or both of the primary slider member and the secondary motion mechanism:

The flexible strip can be slidably articulated to one or both of the primary slider member and the secondary motion mechanism, whereby the distance between the respective primary slider member and the secondary motion mechanism can be adapted;

The zipper assembly can be used in various applications, in different industries and for a variety of purposes, such as clothing/garments, bags/luggage, tents, military/outdoor gear, etc.;

The zipper assembly can be part of, or constitute the side walls of a 3-dimensional object, and wherein displacing the one or both of the primary slider member and the secondary motion mechanism entails opening/closing at least a portion of the object;

A longitudinal axis of the raceway can extend substantially parallel to the zipper path;

The secondary motion mechanism can function as a locking mechanism for the zipper assembly, wherein in the event that the flexible strip is arrested by said secondary motion mechanism, the primary slider member cannot slide at least in one direction.

BRIEF DESCRIPTION OF THE DRAWINGS

In order to better understand the subject matter that is disclosed herein and to exemplify how it may be carried out in practice, embodiments will now be described, by way of non-limiting examples only, with reference to the accompanying drawings, in which:

FIGS. 1A to 1G are directed to a bottom-to-bottom double-slider injection-molded plastic zipper assembly, according to an example of the present disclosure, wherein:

FIG. 1A is a top perspective view of a the zipper assembly;

FIG. 1B is a top planar sectioned view of the zipper assembly of FIG. 1A;

FIGS. 1C and 1D are enlarged views of the portions marked 1C and 1D, respectively, in FIG. 1B;

FIGS. 1E and 1F are enlarged views of the portions marked 1E and 1F, respectively, in FIG. 1D;

FIG. 1G is an enlarged view of the portion marked 1G in FIG. 1B;

FIGS. 2A to 2I are directed to an open ended coil-type zipper assembly, according to another example of the present disclosure, wherein:

FIG. 2A is a top, right perspective view of the zipper assembly;

FIG. 2B is a top, left perspective view of the zipper assembly;

FIG. 2C is a bottom, right perspective view of the zipper assembly;

FIG. 2D is an enlargement of the portion marked 2D in FIG. 2A, however with the left and right tape removed:

FIG. 2E is an enlargement of the portion marked 2E in FIG. 2A, illustrating in greater detail the coiled fastener members;

FIG. 2F is a longitudinal sectioned view along line I-I in FIG. 2A;

FIG. 2G is a planar sectioned view along line II-II in FIG. 2A;

FIG. 2H is a view in direction of arrow H in FIG. 2F;

FIG. 2I is a view in direction of arrow I in FIG. 2G;

FIGS. 3A to 3D are directed to an open ended metal-teeth type zipper assembly, according to yet another example of the present disclosure, wherein:

FIG. 3A is a top perspective view of the zipper assembly;

FIG. 3B is a bottom perspective view of the zipper assembly;

FIG. 3C is an enlarged bottom view, of the portion marked 3C in FIG. 3A;

FIG. 3D is a longitudinal section of a portion, along line in FIG. 3A;

FIGS. 4A to 4E are directed to an open ended, injection-molded plastic zipper assembly, according to yet another example of the present disclosure, configured with a pull ring, wherein:

FIG. 4A is a top perspective view of the zipper assembly at a closed position thereof;

FIG. 4B is a top perspective view of the zipper assembly at an open position thereof;

FIG. 4C is a planar section portion, of the zipper assembly at the open position;

FIG. 4D is longitudinal section portion, along line IV-IV in FIG. 4A;

FIG. 4E is an enlarged end view of the portion marked 4E in FIG. 4A;

DETAILED DESCRIPTION OF EMBODIMENTS

Figure 1A:
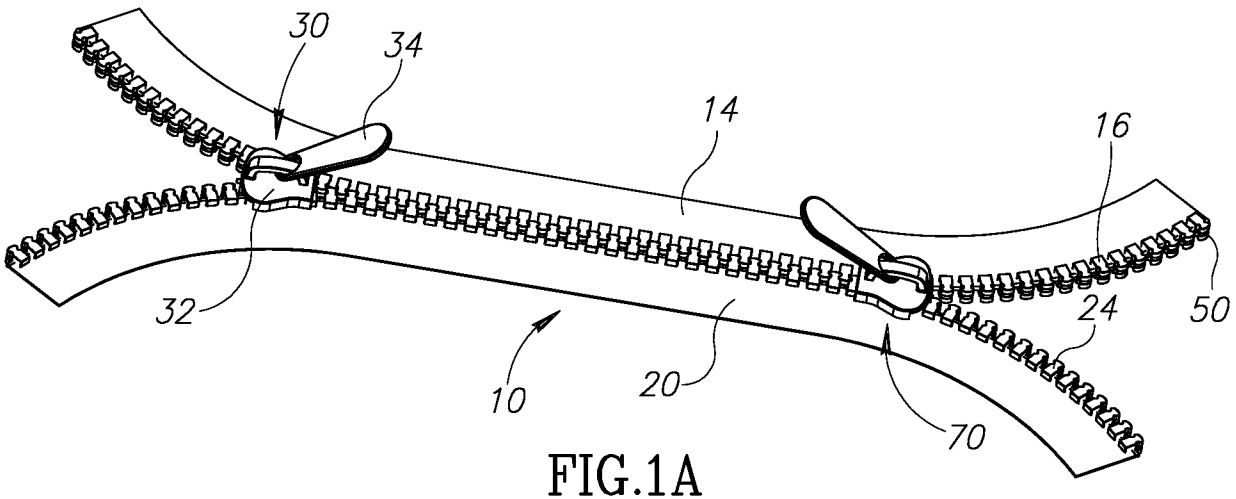
Figure 1B:
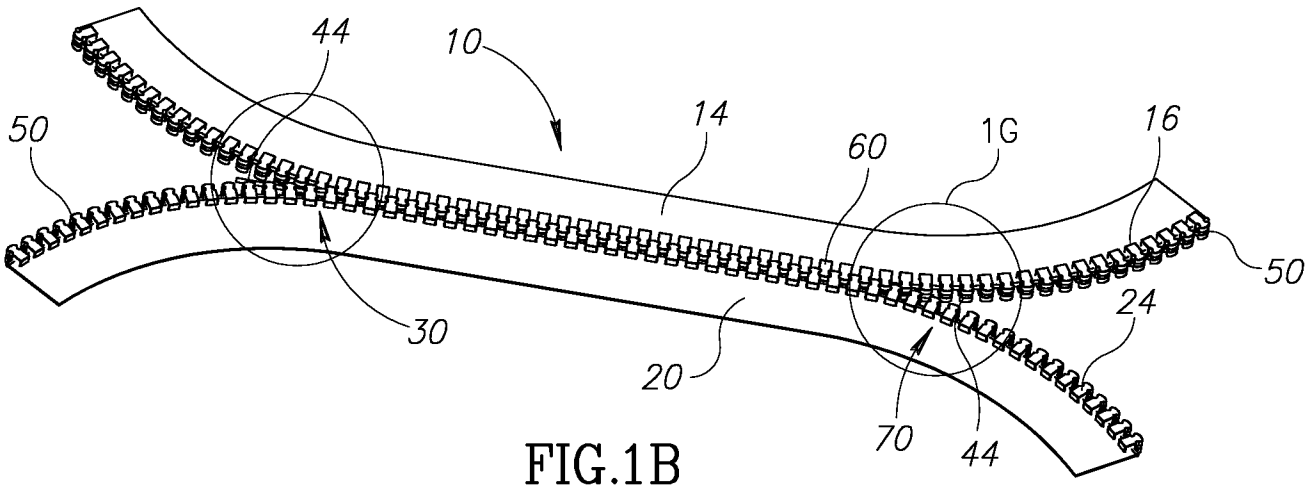
Figure 1C:
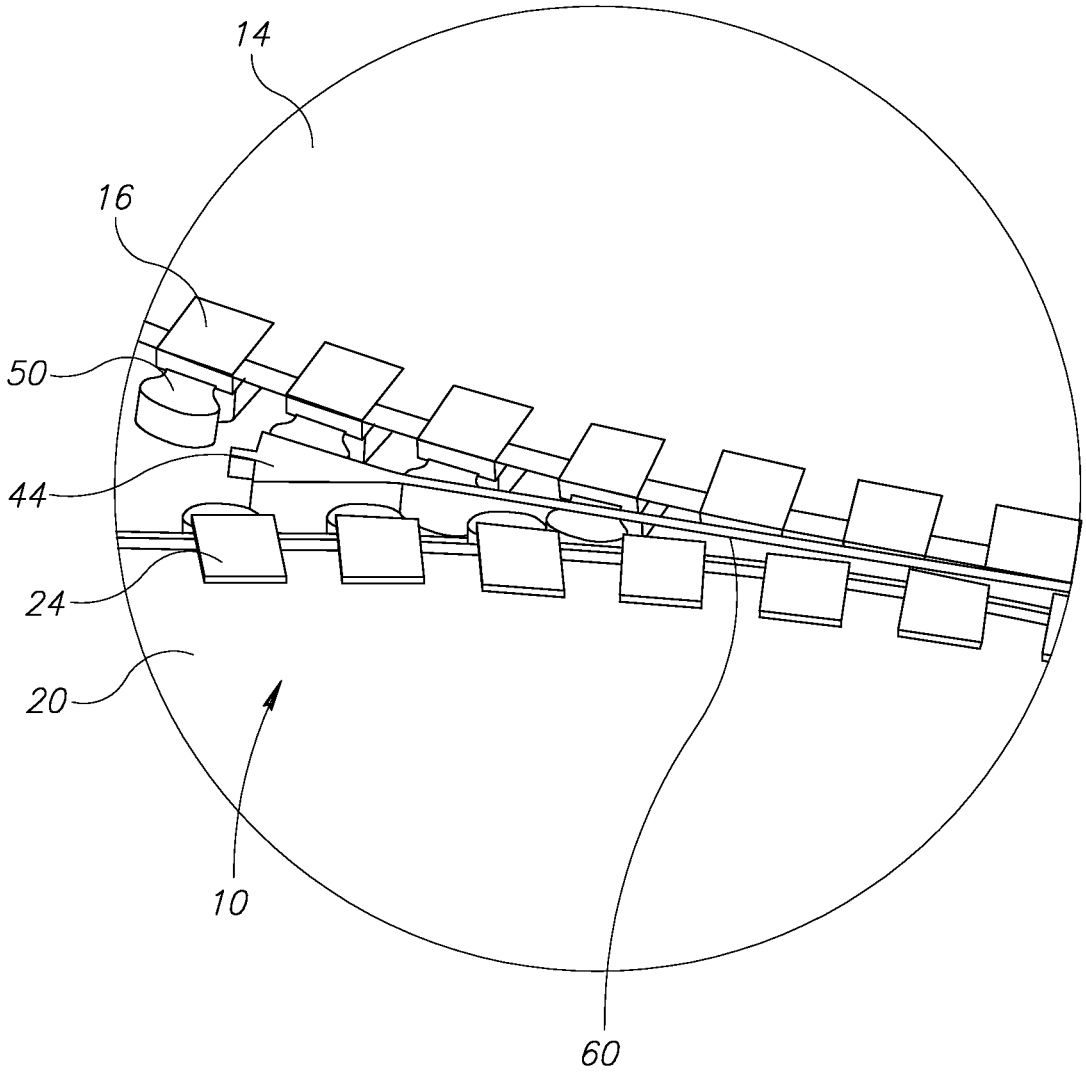

Attention is first directed to FIGS. 1A to 1G of the drawings, illustrating a double sided, bottom-to bottom, zipper assembly, according to an example of the present disclosure, generally designated 10.

The zipper assembly 10 comprises a left side tape 14 configured with a plurality of left fastener teeth 16, and a right side tape 20 configured with a plurality of right fastener teeth 24, defining together a zipper path. In the present example the zipper assembly is a so-called Vision® zipper (namely the teeth are made of injection molded plastic elements set to the zipper tape at regular intervals). The left side tape 14 and the right side tape 20 are made for example of fabric, though any other material, flexible or not, can be used.

A primary slider member generally designated 30 is slidingly displaceable along the zipper path for interlocking engagement or disengagement of right fastener teeth 24 with corresponding left fastener teeth 16. As best seen in FIGS. 1E to 1G, the primary slider member 30 comprises a body 32 and a puller 34, a top board 36, a bottom board 38 (each configured with left and right flanges/rails 40, 42 and a diamond 44 therebetween, said diamond configured for disengaging engaged left and right teeth from one another.

Further noted, the left fastener teeth 24 and right fastener teeth 16 are each configured with a recess 50, said recesses having a generally U-like shape, with the opening facing away from the respective carrying tape (i.e. facing towards opposite left/right tooth, respectively), giving rise to a raceway extending along alternating neighboring left fastener teeth 24 and right fastener teeth 16. At a closed (engaged) position of the zipper assembly the raceway slidingly accommodates a flexible strip 60, articulated at a first end thereof to the diamond 44 of the primary slider member 30.

The flexible strip 60, in the example, is a circular sectioned cord, made of any pliable material. It can be for example a polymeric line, a flexible metal cord, etc. When the strip 60 is sufficiently rigid, it could be used also for pushing, however requiring minimal friction. Otherwise, the flexible strip 60 is used for pulling at least the respective primary slider member, as will be disclosed hereinafter, and optionally also a secondary motion mechanism. The first end of the flexible strip 60 is fixedly set within the diamond 44 of the primary slider 30 (though according to some other examples, not shown, the first end of the strip member can be slidingly articulated to a body portion of the primary slider member).

Figure 1D:
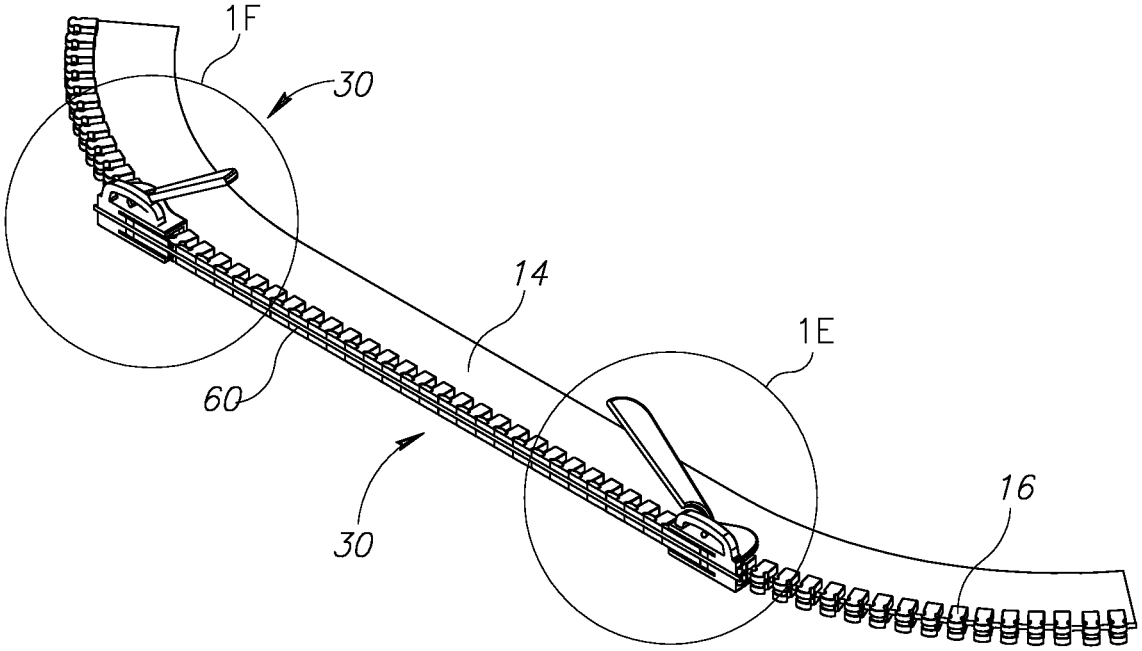
Figure 1E:
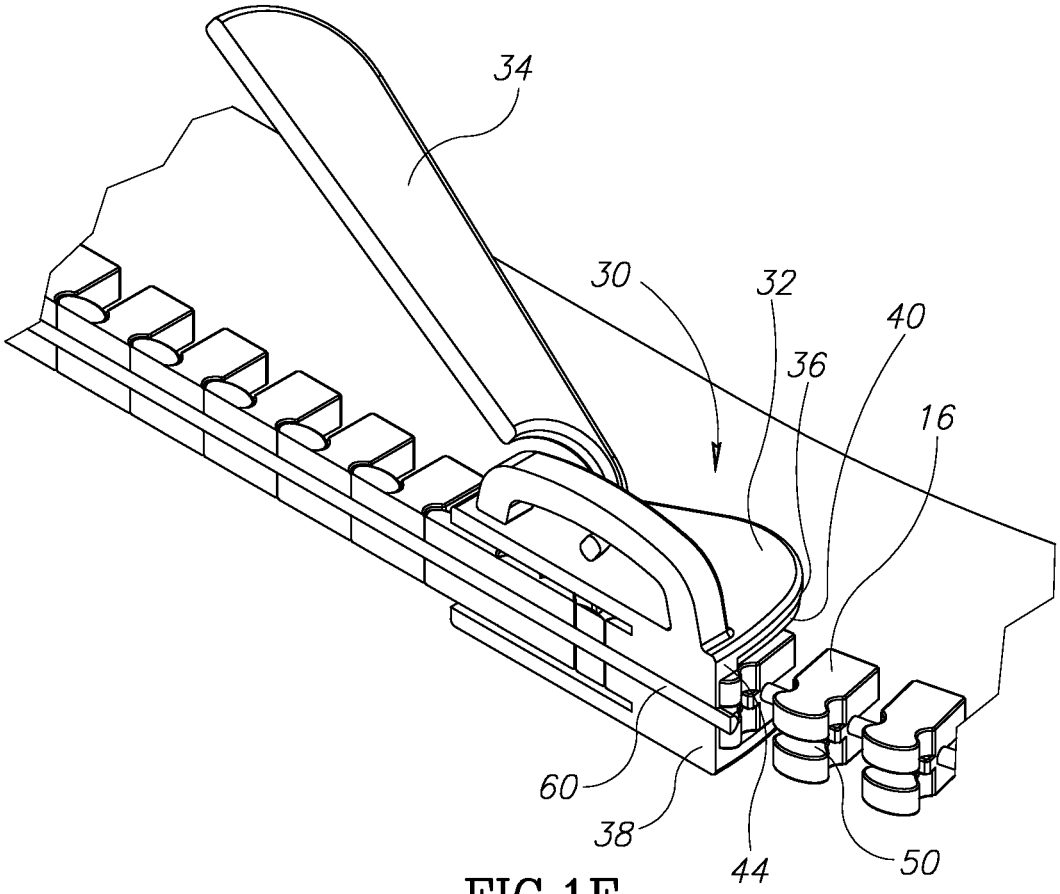
Figure 1F:
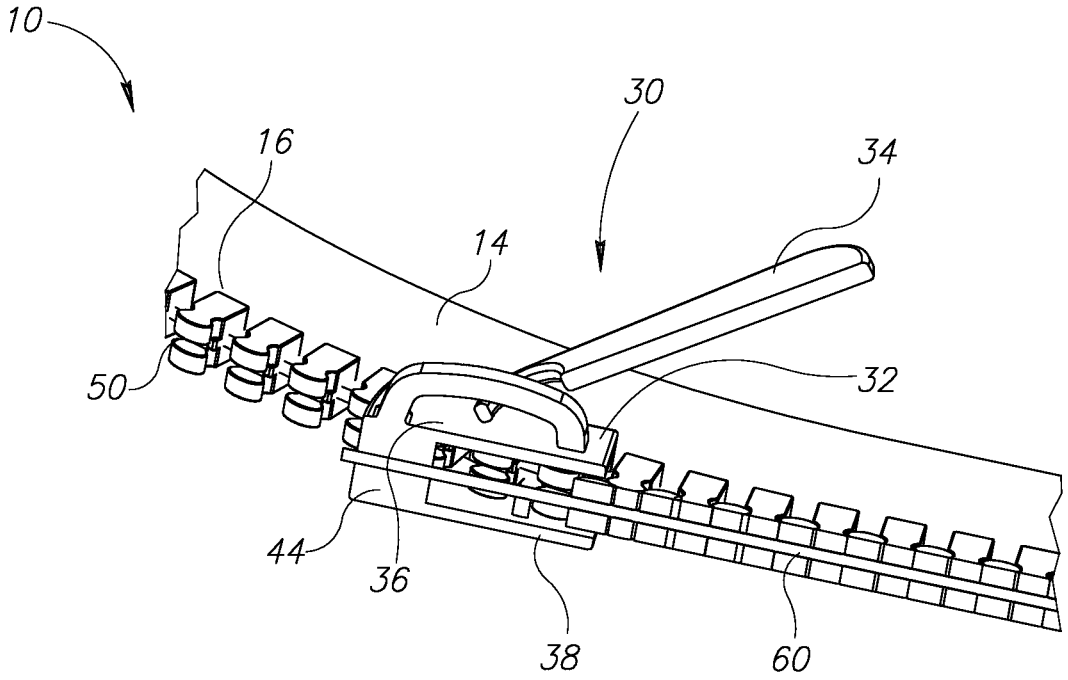
Figure 1G:
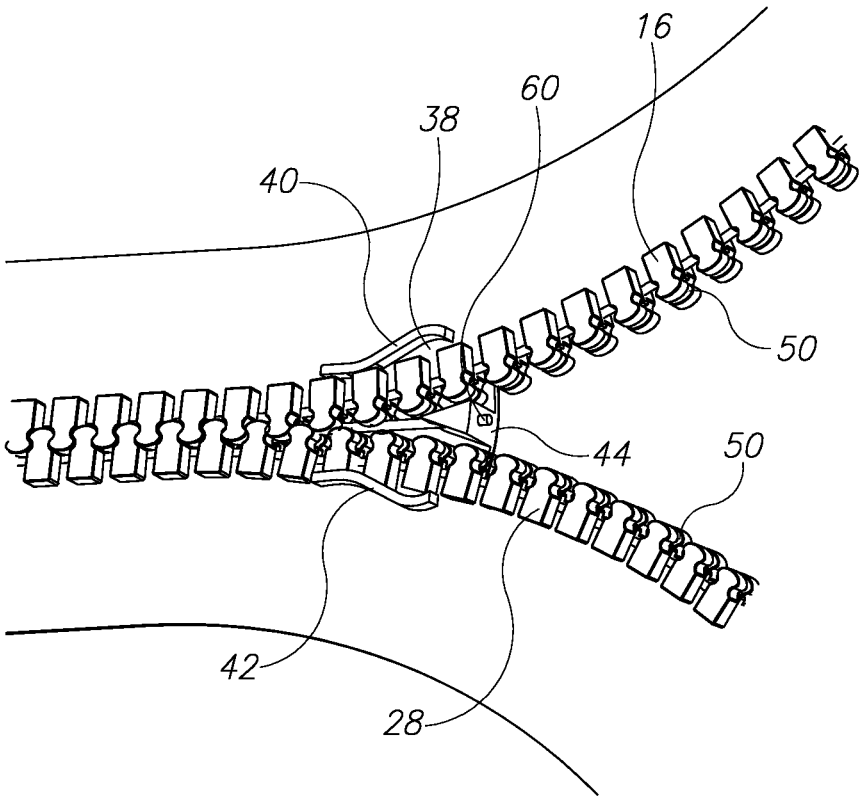

In the present example, as can best be seen in FIGS. 1A and 1D, an opposite end of the flexible strip 60 is secured to a secondary motion mechanism, namely a second slider 70, disposed at a so-called bottom-to-bottom orientation, wherein displacing one of the primary slider member 30 and the secondary second slider 70, along the path of the zipper assembly, entails reactionary motion of the other one of the primary slider member 30 and the second slider 70, in a following sense, in a master-slave relation (i.e. pulling the one of the two sliders 30 and 70 in one direction entails simultaneous displacement of the other one of the two sliders 30 and 70 in the same direction, and likewise, pushing one of the two sliders 30 and 70 in one direction entails simultaneous displacement of the other one of the two sliders 30 and 70 in the same direction), as will be further exemplified hereinafter with further reference to FIGS. 8A to 8E.

Attention is now directed to FIGS. 2A to 2I illustrating another example, of the present disclosure. The example is directed to a zipper assembly generally designated 80, comprises a left side tape 84 configured with a plurality of left fastener teeth 86, and a right side tape 88 configured with a plurality of right fastener teeth 92, defining together a zipper path. However, in the present example the zipper assembly is a so-called coil zipper (made of a continuous spiral plastic element articulated to the respective zipper tape, wherein each thread functions as a zipper tooth).

A primary slider member 100 is slidingly displaceable along the zipper path for interlocking engagement or disengagement of left fastener teeth 86 with corresponding right fastener teeth 92, said primary slider member 100 being substantially similar to slider element 30 of the previous example discussed in greater detail in FIGS. 1A to 1G, whereby like reference numbers are used.

The fastener teeth of the coiled fasteners are configured out of the coiled member, wherein, as can best be seen in FIGS. 2D, 2E, 2H and 2I, each coil is configured with an indented portion forming a recess 104, which together give rise to a raceway extending along alternating neighboring left fastener teeth 86 and right fastener teeth 92. At a closed (engaged) position of the zipper assembly 80 the raceway slidingly accommodates a flexible strip 110, fixedly articulated at a first end thereof 112 to the diamond 44 of the primary slider member 100.

Figure 2A:
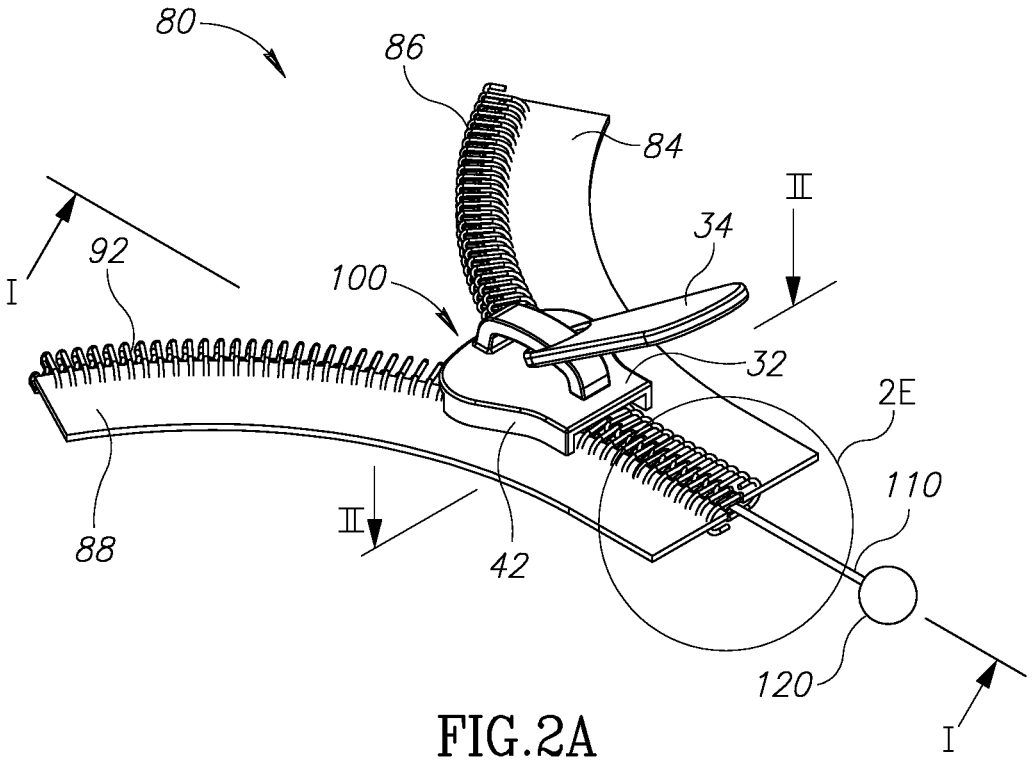
Figure 2B:
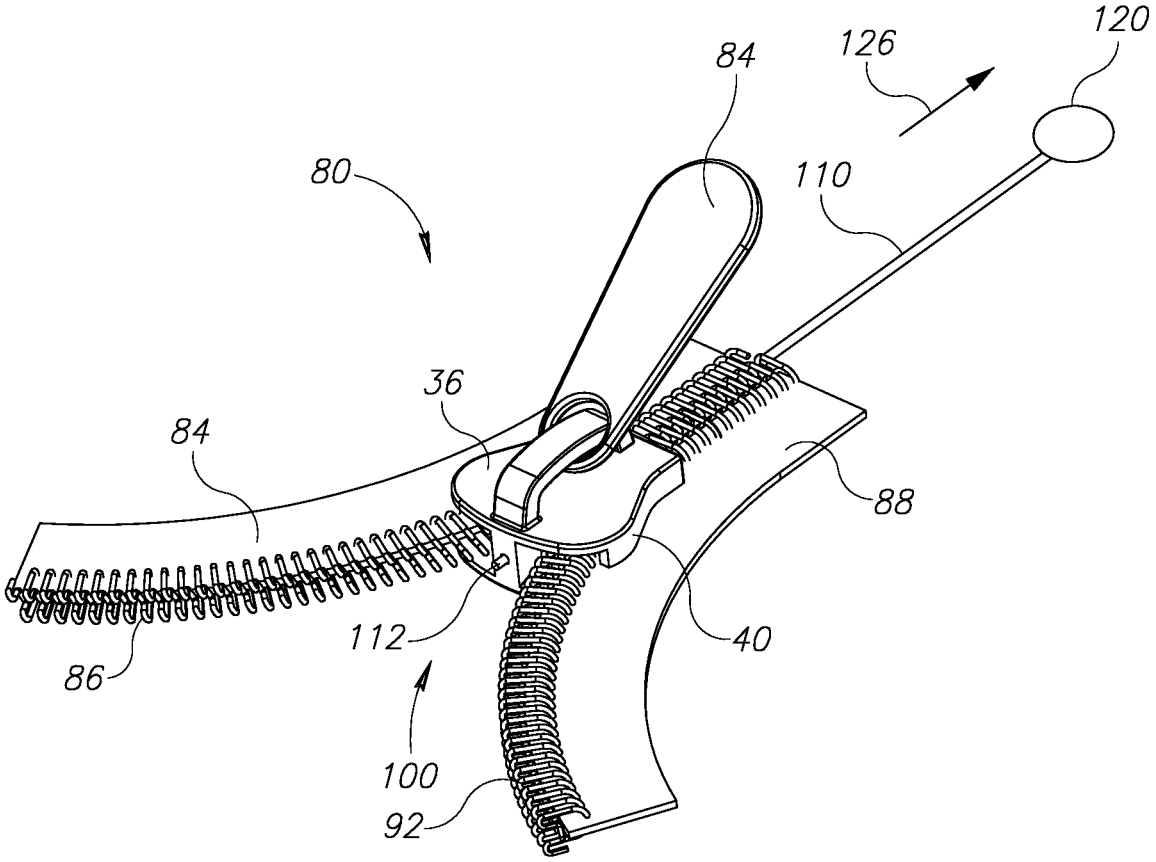
Figure 2C:
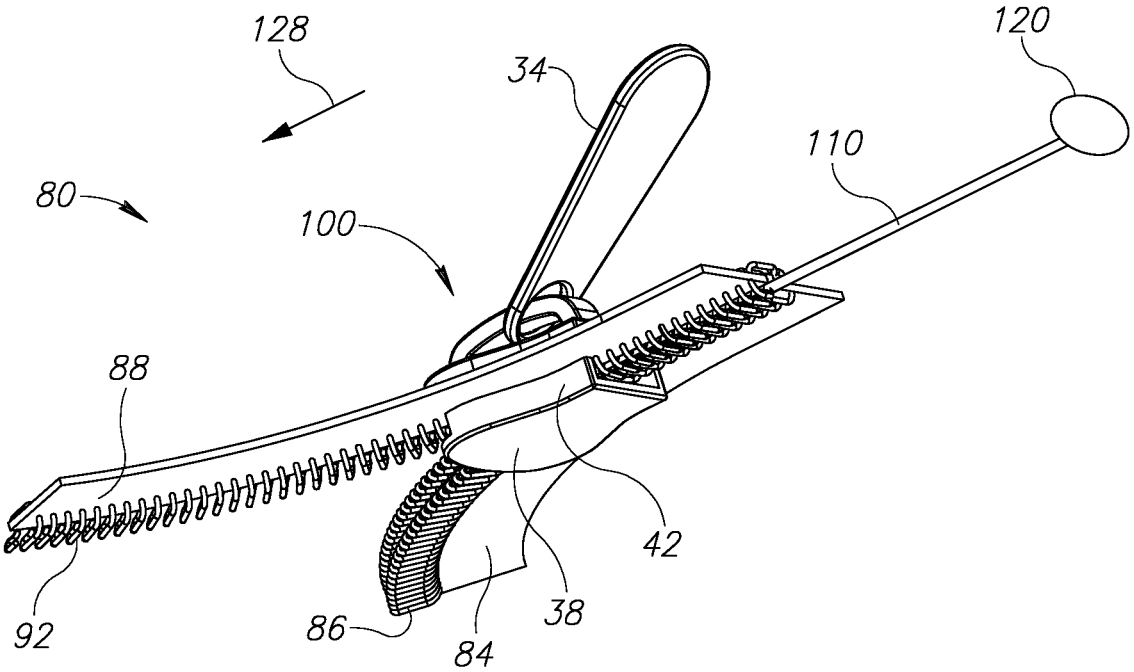
Figure 2D:
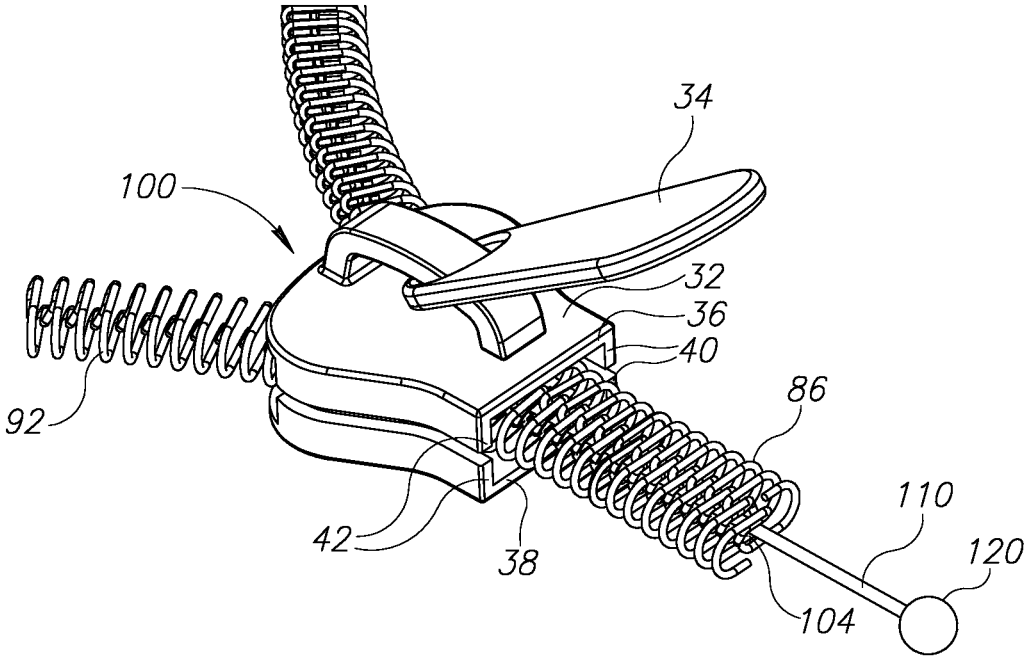
Figure 2E:
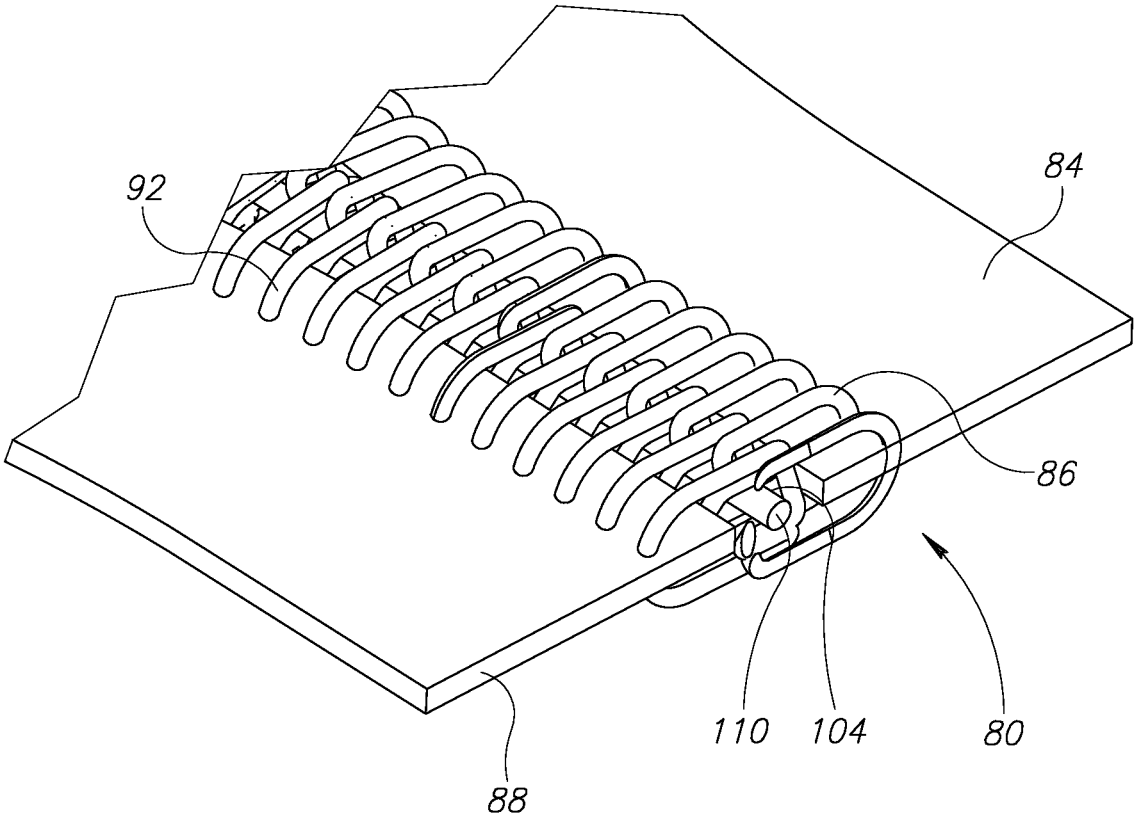
Figure 2F:
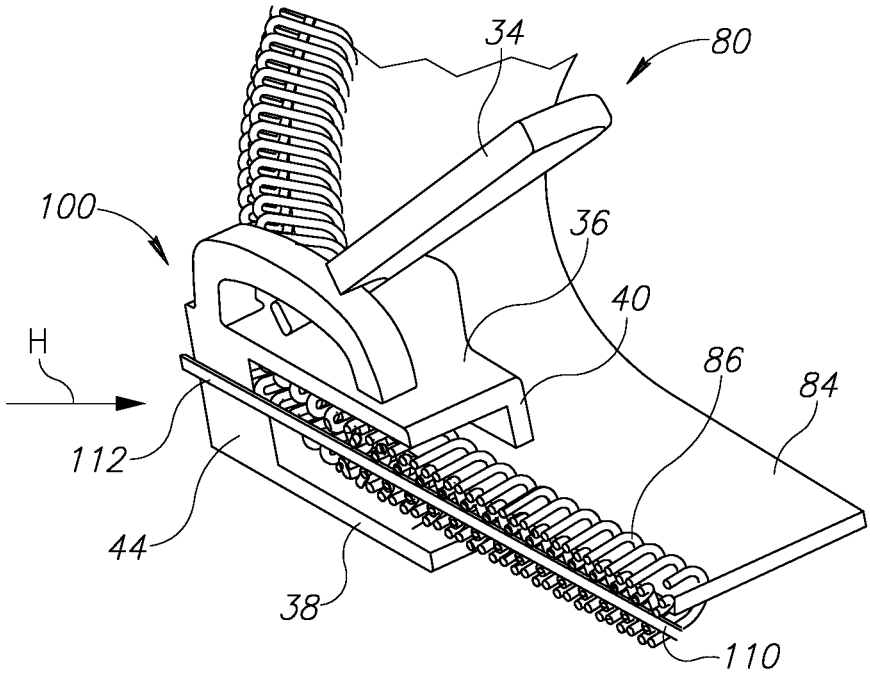
Figure 2G:
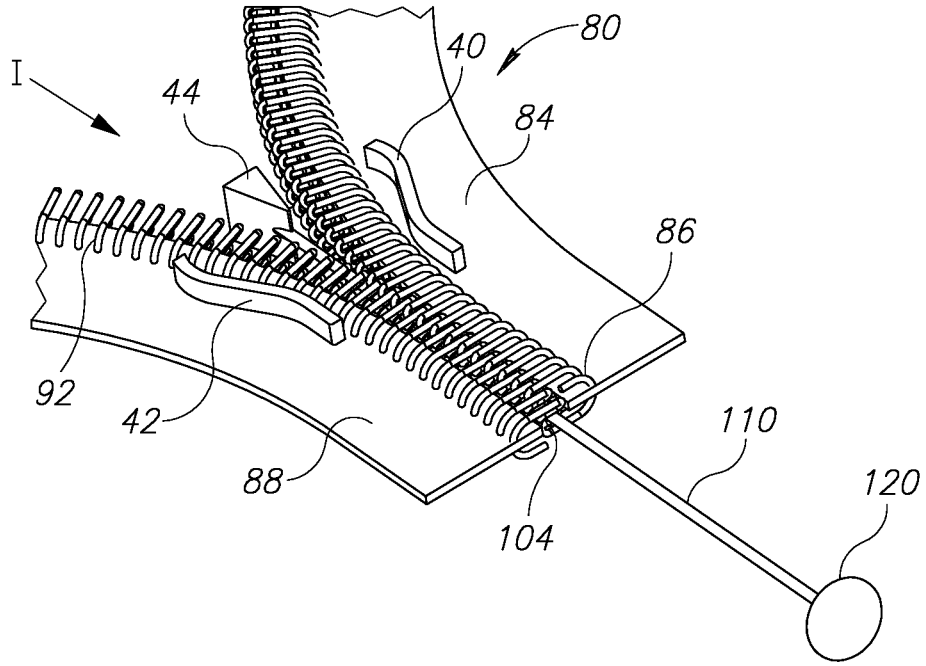
Figure 2H:
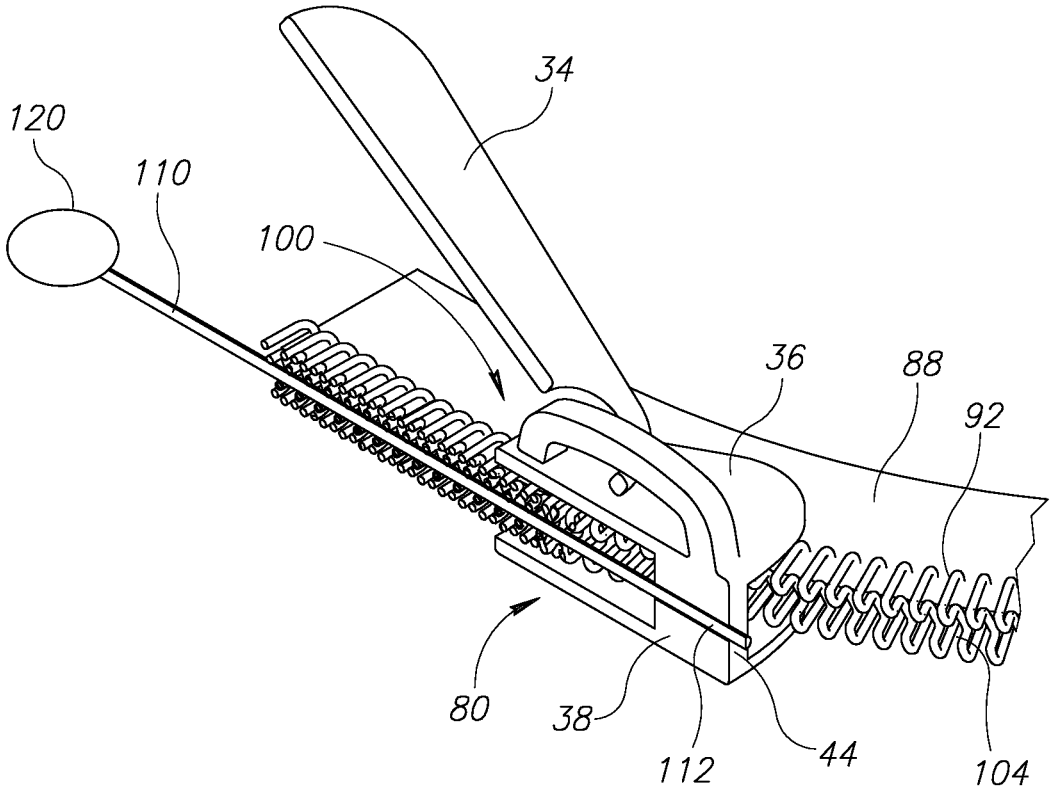
Figure 2I:
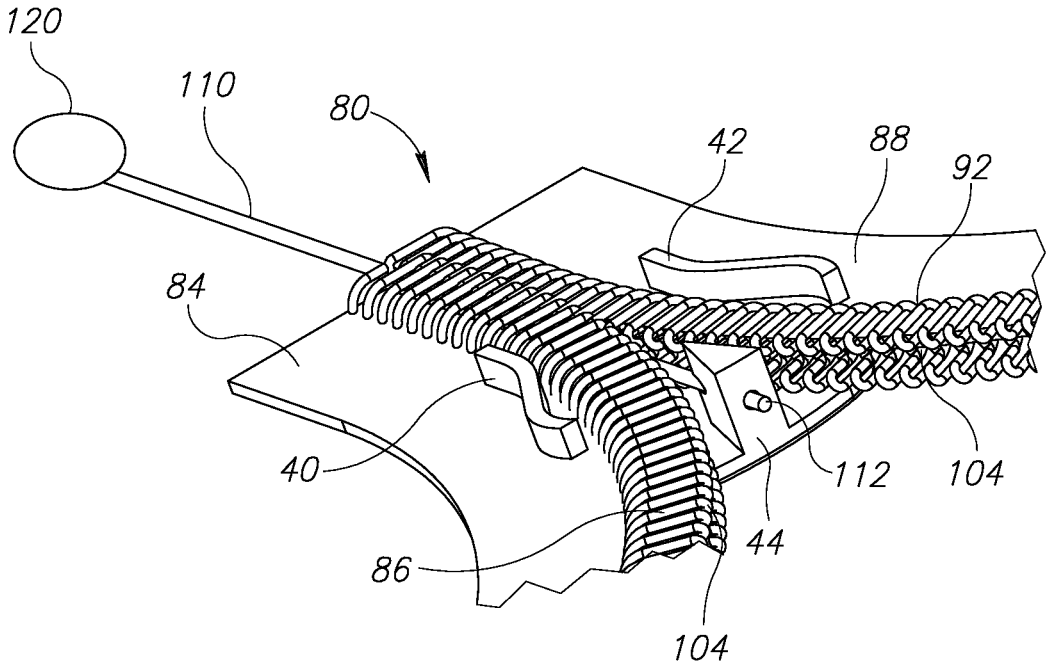

In the example of FIGS. 2A to 2I an opposite end of the flexible strip 110 is secured to a secondary motion mechanism, in the form of a pull ring 120, extending outside of the zipper path, wherein pulling the pull ring in a direction away from zipper path (in direction of arrow 126; FIG. 2B) results in reactionary motion of the primary slider member 100 into opening/disengaging the zipper assembly, in a master-slave relation, whilst pulling the primary slider member 100 in an opposite direction (arrow 128 in FIG. 2C) entails retraction of the flexible strip 110 inwards (i.e. in an inwards direction, into the raceway).

Yet another example is illustrated in FIGS. 3A to 3D, directed to a zipper assembly generally designated 150 being of substantially similar design as the example of FIG. 2, however with the difference residing in the type of zipper teeth. In this example the zipper assembly 150 comprises a left side tape 154 configured with a plurality of left fastener teeth 156, and a right side tape 158 configured with a plurality of right fastener teeth 160, defining together a zipper path. However, in the present example the zipper assembly is a so-called metal zipper (i.e. comprising multiple pieces of metal teeth secured to the zipper tape at regular intervals).

Similar to the previous example, there is provided a primary slider member 166 slidingly displaceable along the zipper path, for interlocking engagement or disengagement of left fastener teeth 156 with corresponding right fastener teeth 160, said primary slider member 166 being substantially similar to slider element 30 of the first example, discussed in greater detail in FIGS. 1A to 1G, whereby like reference numbers are used.

The fastener teeth of the metal fasteners 156 and 160 are individual metal made teeth, each configured with an indented/cutout portion forming a recess 170, which together give rise to a raceway extending along alternating neighboring left fastener teeth 156 and right fastener teeth 160. At a closed (engaged) position of the zipper assembly 150, the raceway slidingly accommodates a flexible strip, namely cord 176, fixedly articulated at a first end thereof 178 to the diamond 44 of the primary slider member 166.

Figure 3A:
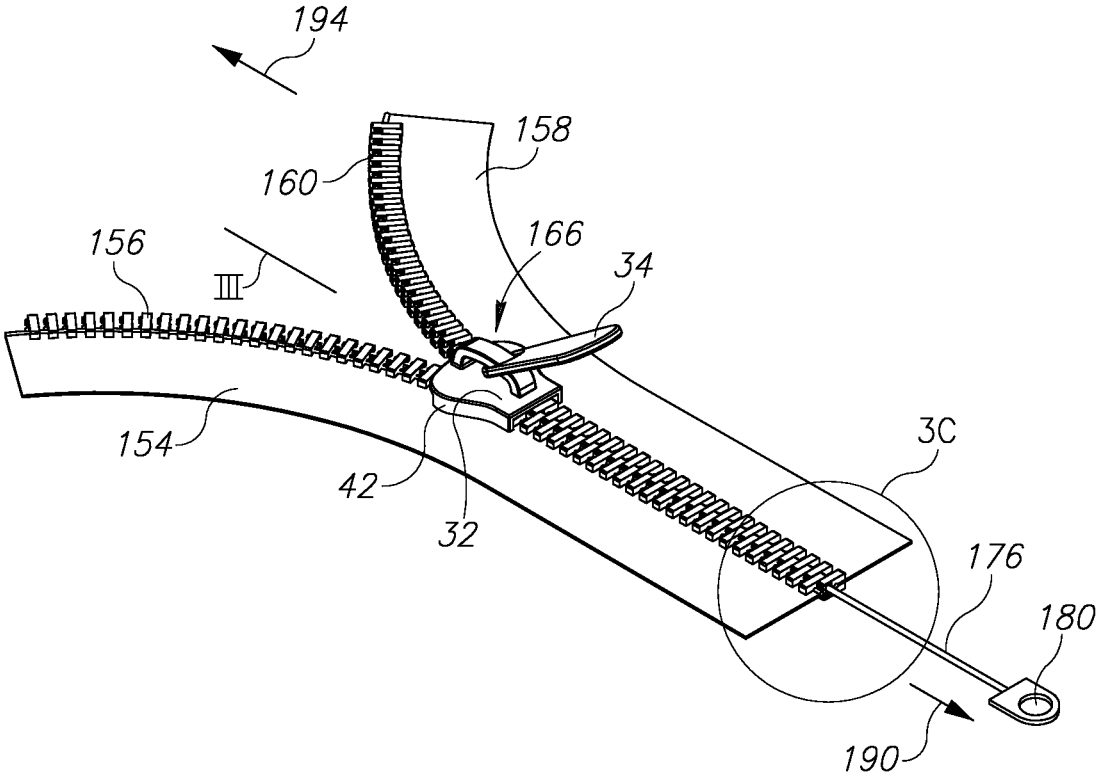
Figure 3B:
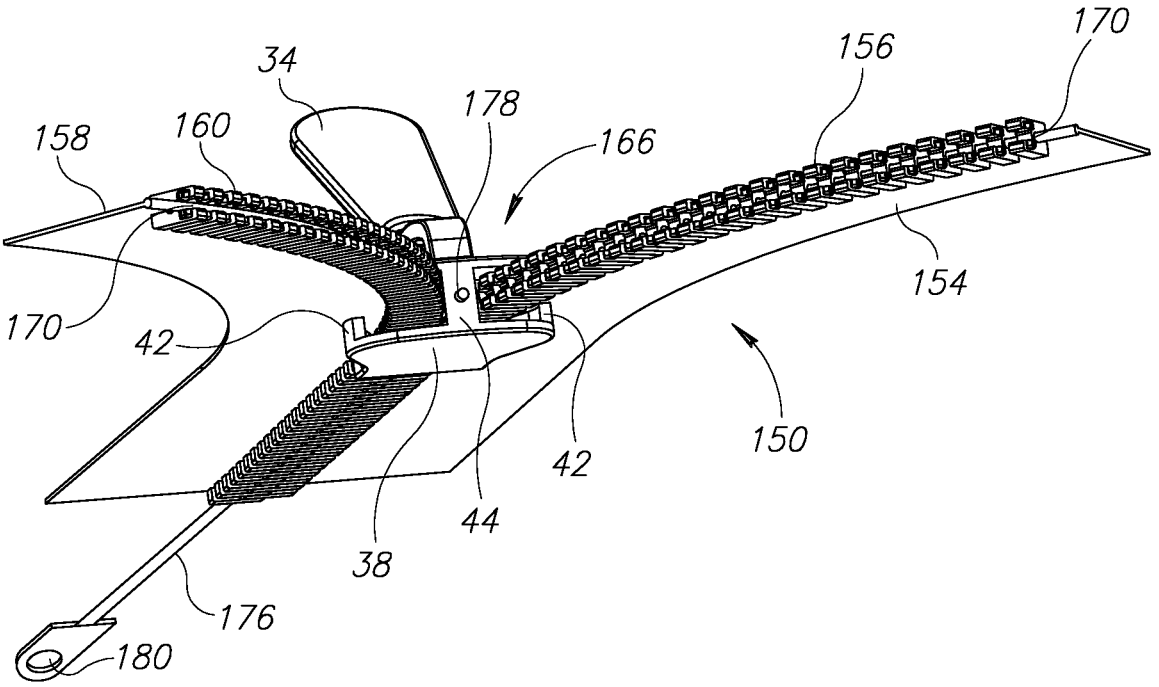
Figure 3C:
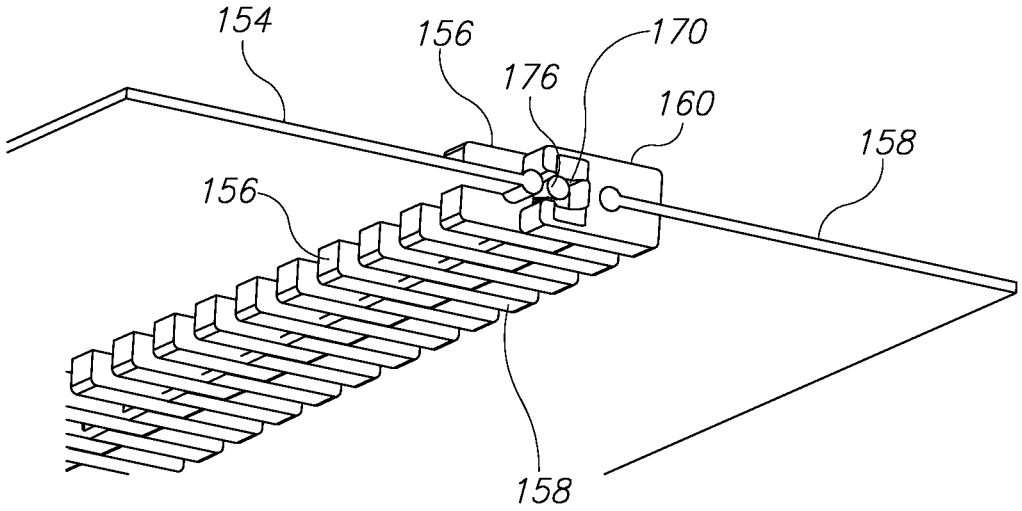
Figure 3D:
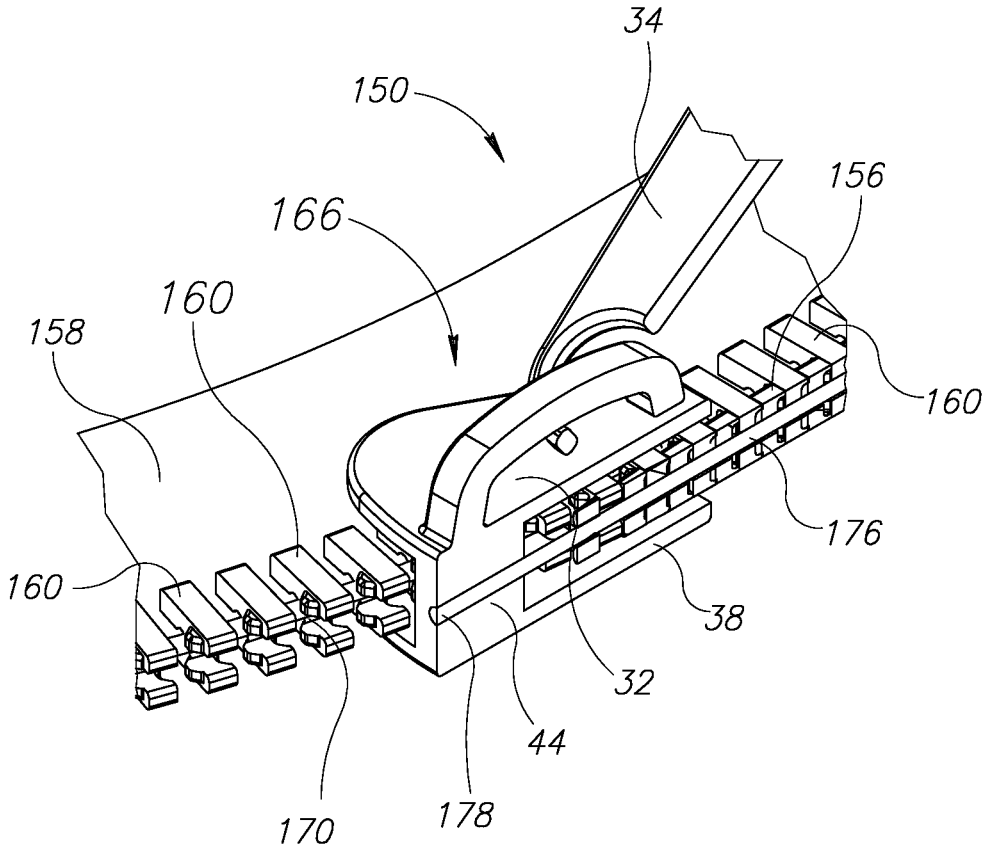

In the example of FIGS. 3A to 3D an opposite end of the flexible cord 176 is secured to a secondary motion mechanism, in the form of a pull tab 180 (FIGS. 3A and 3B), extending outside of the zipper path, wherein pulling the pull tab in a direction away from zipper path (in direction of arrow 190; FIG. 3A) entails reactionary motion of the primary slider member 166 into opening/disengaging the zipper assembly, in a master-slave relation, whilst pulling the primary slider member 166 in an opposite direction (arrow 194 in FIG. 2A) entails retraction of the flexible cord 176 inwards (i.e. in an inwards direction, into the raceway).

FIGS. 4A to 4D are directed to yet another example of a zipper assembly according to the disclosure, being an open ended, injection-molded plastic zipper assembly (a Vision® zipper) generally designated 200, which is principally similar to the example discussed in connection with FIGS. 1A to 1G herein above.

The zipper assembly 200 comprises a left side tape 208 configured with a plurality of left fastener teeth 210, and a right side tape 212 configured with a plurality of right fastener teeth 214, defining together a zipper path. The two zipper tapes are separable and are attachable to one another at their respective ends through a fastener box 218 and an insertion pin 220.

Similar to the previous examples, and in particular to the example of FIG. 1, the fastener teeth 210 and 214 are each configured with an indented/cutout portion forming a recess 228 and 230, respectively, which together give rise to a raceway extending along the zipper path, through the alternating neighboring left fastener teeth 210 and right fastener teeth 214. At a closed (engaged) position of the zipper assembly 200, the raceway slidingly accommodates a flexible strip, namely cord 232, fixedly articulated at a first end thereof 234 to a diamond 44 of a primary slider member 238.

Figure 4A:
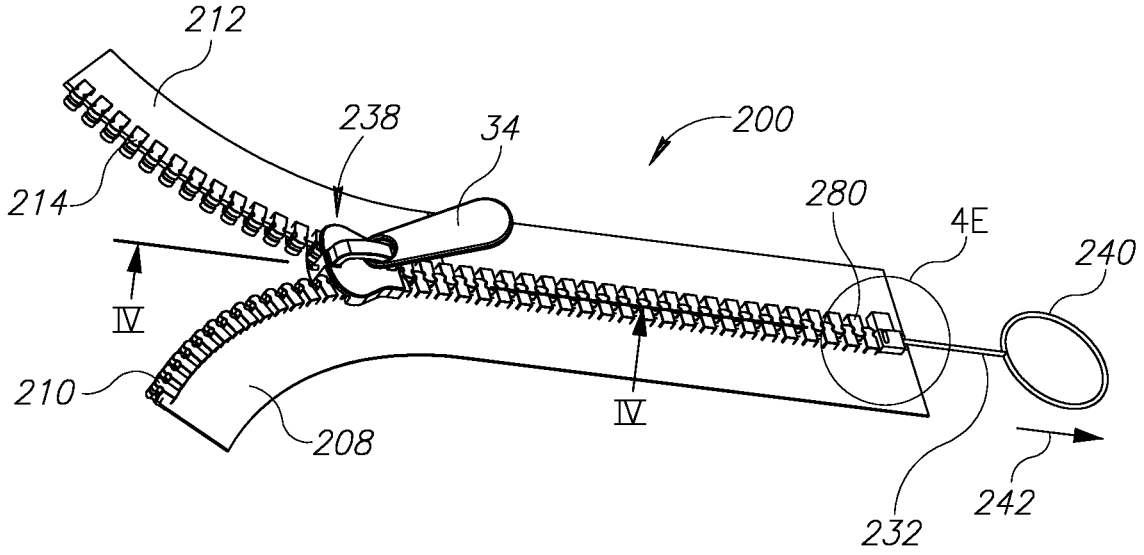
Figure 4B:
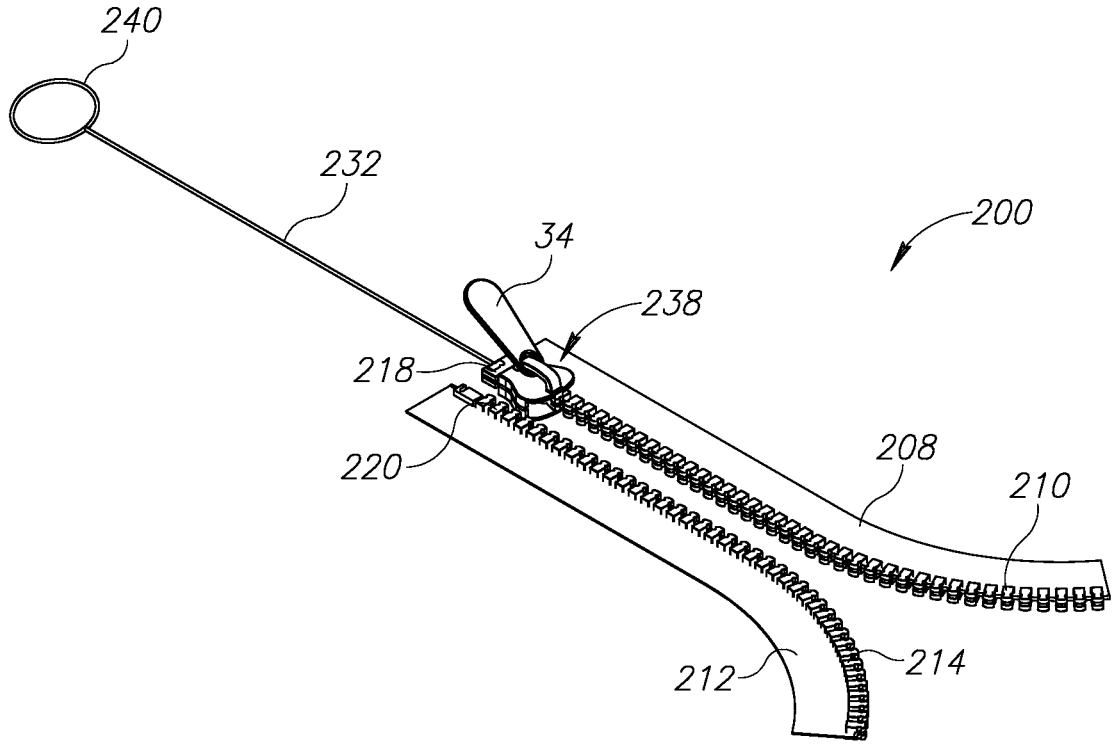
Figure 4C:
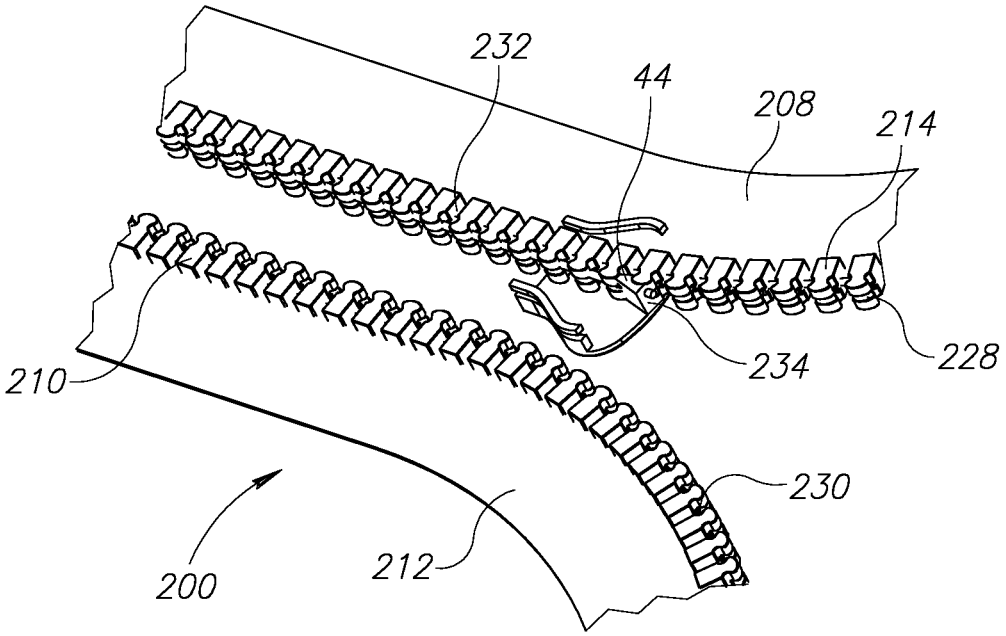
Figure 4D:
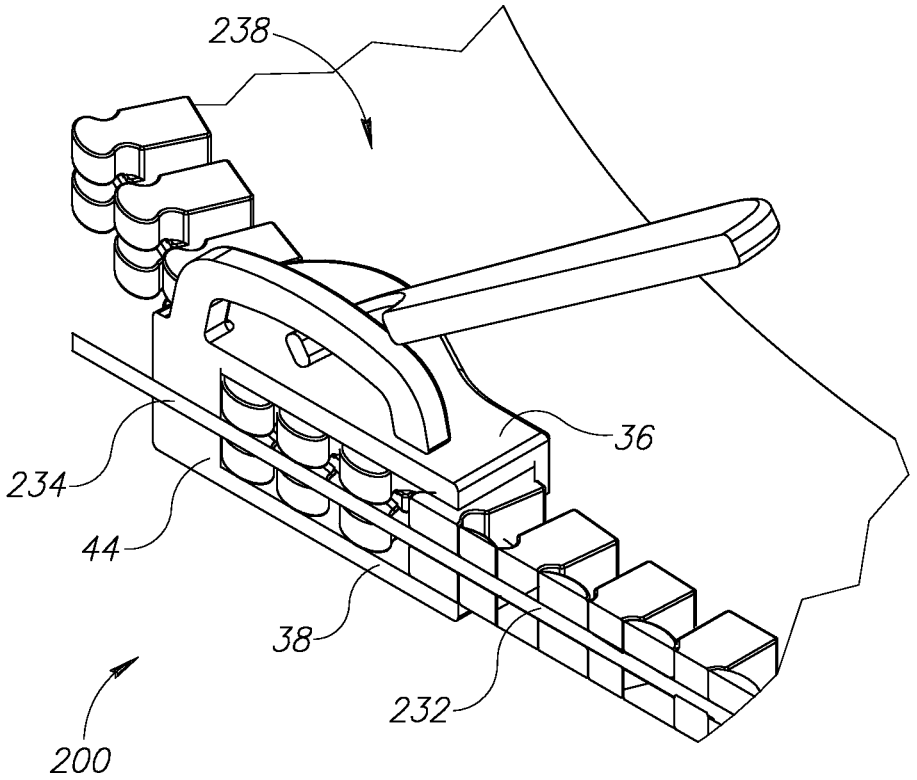
Figure 4E:
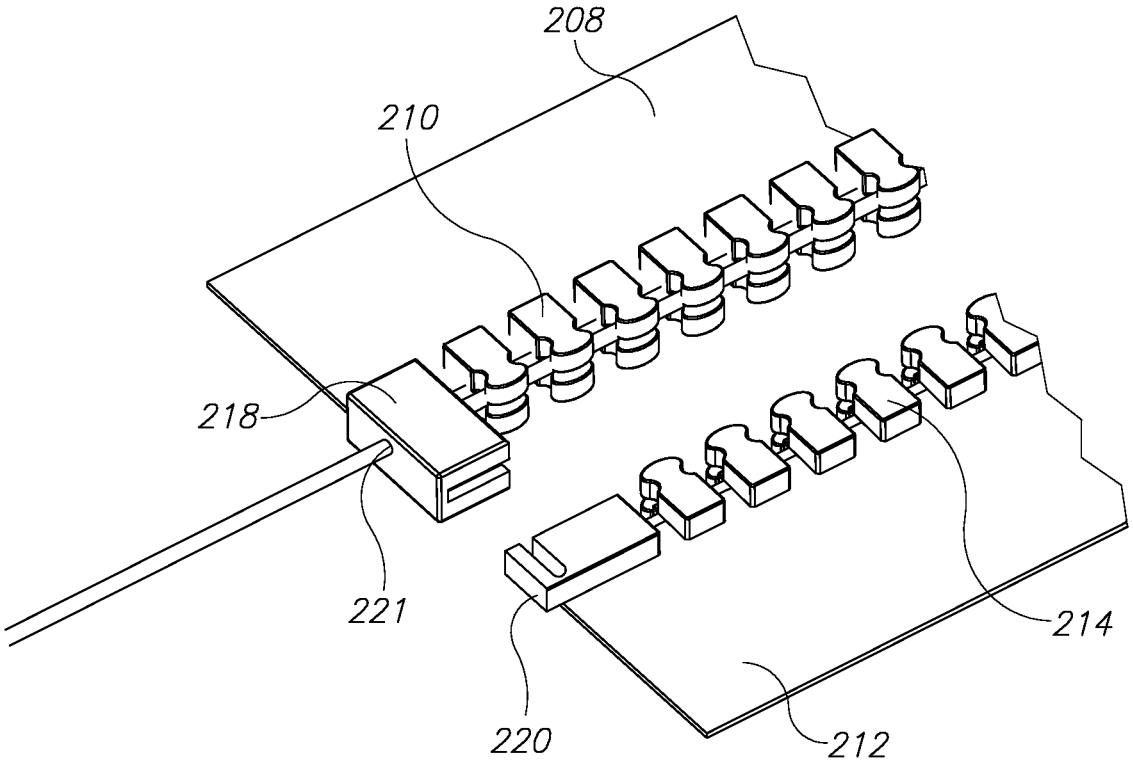

It is noted that the raceway extends further through the fastener box 218, whereby the cord 232 is slidably displaceable through an opening 221 formed at fastener box 218 (FIG. 4E).

An opposite end of the flexible cord 232 is secured to a secondary motion mechanism, in the form of a pull tab 240 (FIGS. 4A and 4B), extending outside of the zipper path, wherein pulling the pull tab 240 in a direction away from zipper path (in direction of arrow 242; FIG. 4B) entails reactionary motion of the primary slider member 238 into opening/disengaging the zipper assembly, in a master-slave relation, whereby the zipper is open and the tapes can be separated from another (FIG. 4B). Likewise, pulling the primary slider member 238 in an opposite direction entails retraction of the flexible cord 232 inwards (i.e. in an inwards direction, into the raceway).

Figure 5A:
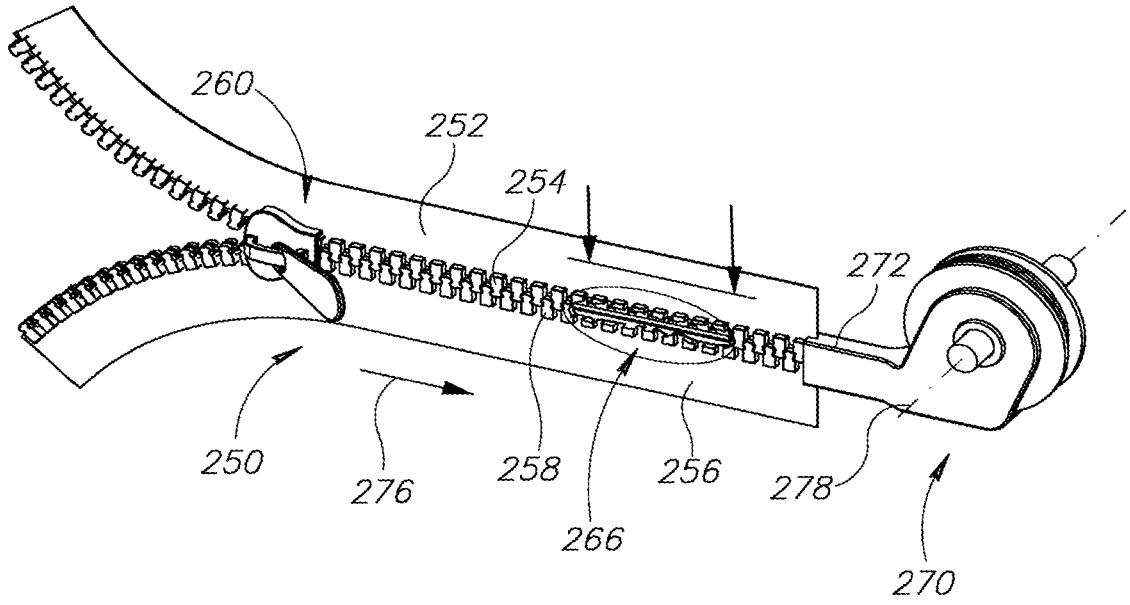
FIGS. 5A and 5B illustrate a zipper assembly with an articulated retraction mechanism, and a motorized retraction mechanism, respectively.

In FIG. 5A there is illustrated a zipper assembly according to yet another example of the disclosure, generally designated 250, of principally the same construction as any one of the previous examples, namely comprising a left side tape 252 configured with a plurality of left fastener teeth 254, and a right side tape 256 configured with a plurality of right fastener teeth 258, defining together a zipper path, and a primary slider member 260 slidingly displaceable along the zipper path for interlocking engagement or disengagement of left fastener teeth with corresponding right fastener teeth. The zipper path is configured with a raceway extending along the alternating neighboring left fastener teeth 254 and right fastener teeth 258, said raceway slidingly accommodating a flexible strip (cord) 266 (seen through partially cutout portion) and articulated at a first end thereof to the slider member 260, as discussed before. However, an opposite end of the flexible cord 266 is wound into a spring biased retraction mechanism 270 attached to the zipper path through a fastener tab 272.

The arrangement is such that opening the zipper assembly 250, namely slidingly displacing the slider member 260 in direction of arrow 276 is made easier through cord pulling assistance imparted by the retraction mechanism 270.

In addition, other advantages can be gained through converting linear motion imparted to the sliding member 260 and converted into rotary motion of a rotary axis 278 of the retraction mechanism 270.

Figure 5B:
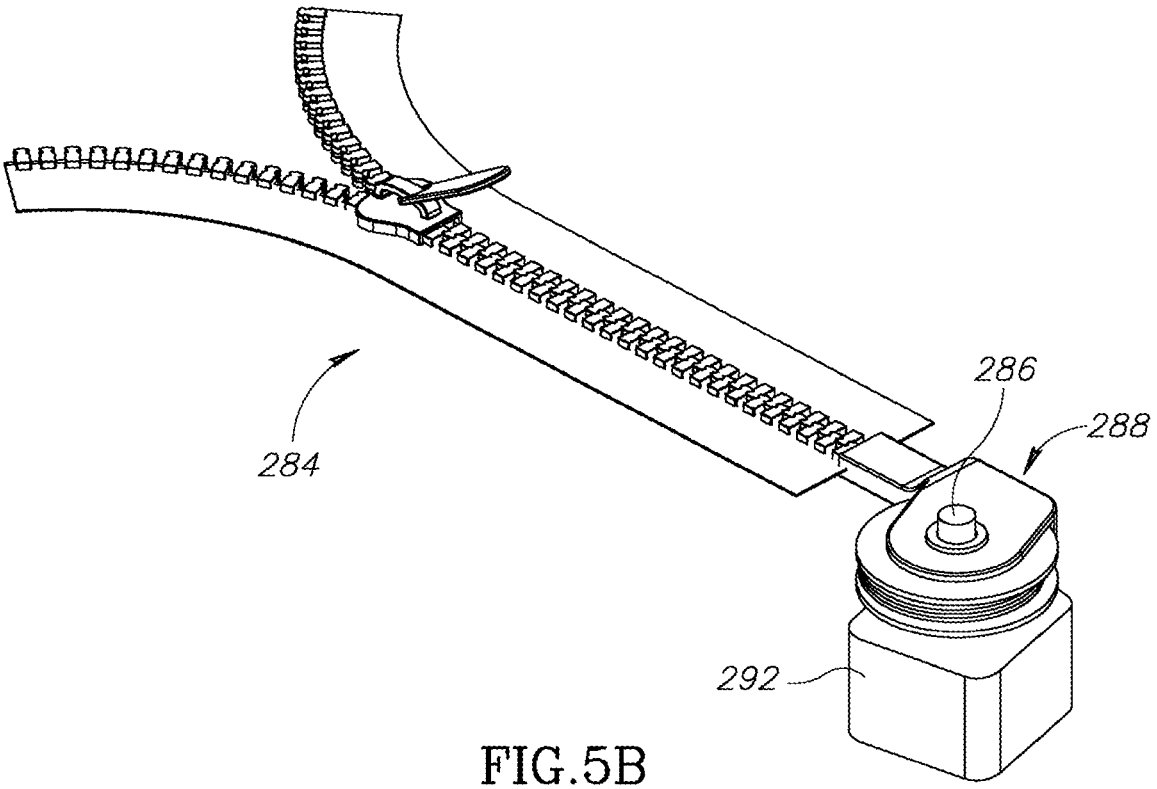

The zipper assembly 284 disclosed in FIG. 5B is substantially similar to that disclosed in connection with FIG. 5A above, however wherein an axle 286 of a cord winding/unwinding mechanism 288 is associated with a motorized unit 292, suitable for imparting rotary motion to the mechanism 288 for respective coil pickup/dispensing, depending on rotary direction. Furthermore, the unit 292 can be associated with a remote controller or, an electric signal generating unit, such as a rotary potentiometer, for generating an electric signal responsive to rotation of the axle 286. It should be realized that a linear potentiometer can be associated with the at least one primary slider member or the secondary motion mechanism, as well.

According to an example of the disclosure, the secondary motion mechanism can function as a locking mechanism for the zipper assembly, wherein in the event that the flexible strip is arrested by said secondary motion mechanism, the primary slider member cannot slide at least in one direction. Given the example of FIG. 5B, if the flexible strip 266 is made for example of a metallic cord, the primary slider member 260 cannot be displaced along the zipper path, unless the secondary mechanism 288 is released to revolve upon a signal to unit 292 facilitating rotation thereof.

Various use illustrations of a zipper assembly according to the present disclosure are provided, by way of example only, in FIGS. 6 to 8.

Figure 6A:
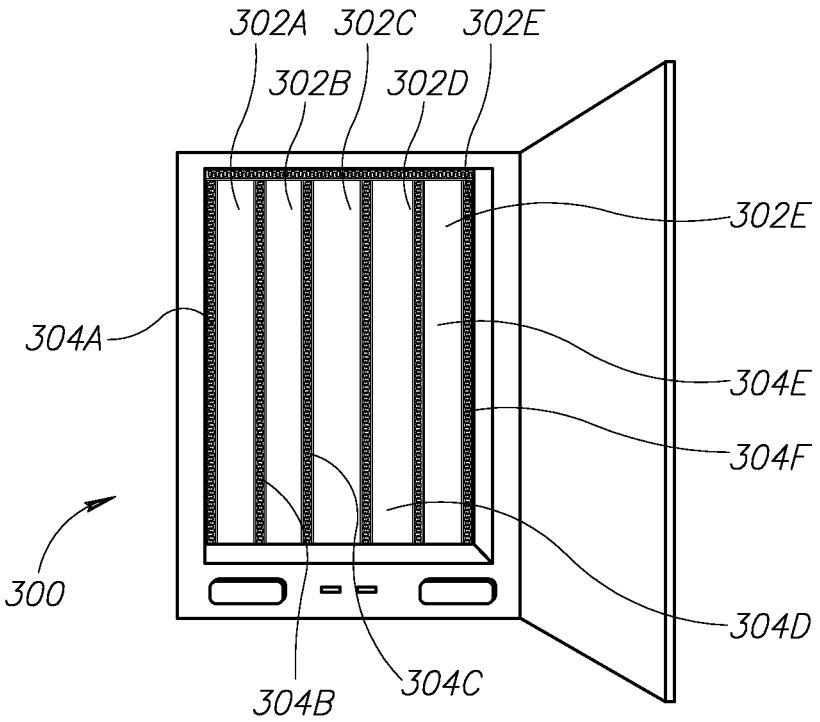
FIGS. 6A and 6B illustrate examples of different articles configured with a zipper assembly according to the disclosure.

In FIG. 6A there is illustrated a curtain wall, e.g. of the type used in refrigerator trucks, green houses, refrigerated storage rooms, clean rooms and the like. the curtain wall 300 comprises several vinyl panels 302A to 302E, wherein edges of the panels are secured to edges of neighboring panels and to the side walls of the truck, respectively, by zipper assemblies 304A-304E as per any configuration of the present disclosure, and whereby the curtain wall can be easily opened/closed.

Figure 6B:
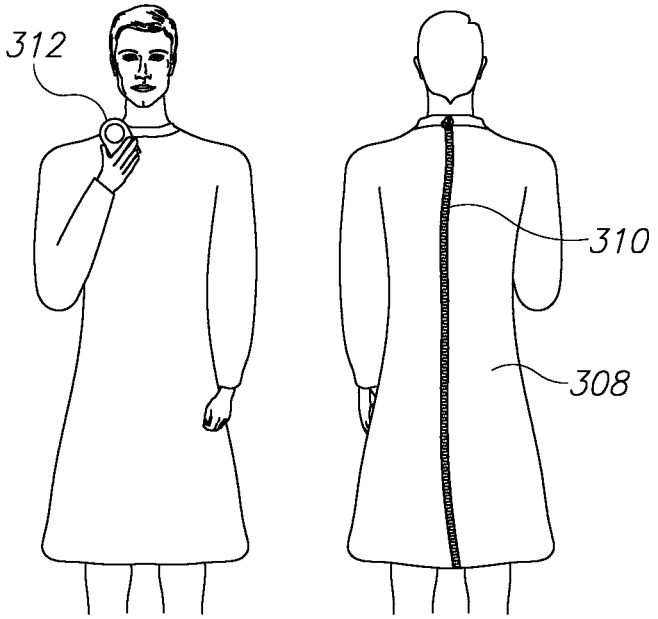

In FIG. 6B there is illustrated a garment, e.g. a surgeon's gown 308 configured with a full length zipper closure 310 at a back thereof, with a zipper manipulating mechanism, namely a secondary motion mechanism as per the present disclosure, in the form of a pull tab 312 at a front, easily accessible location of the gown.

Figure 7A:
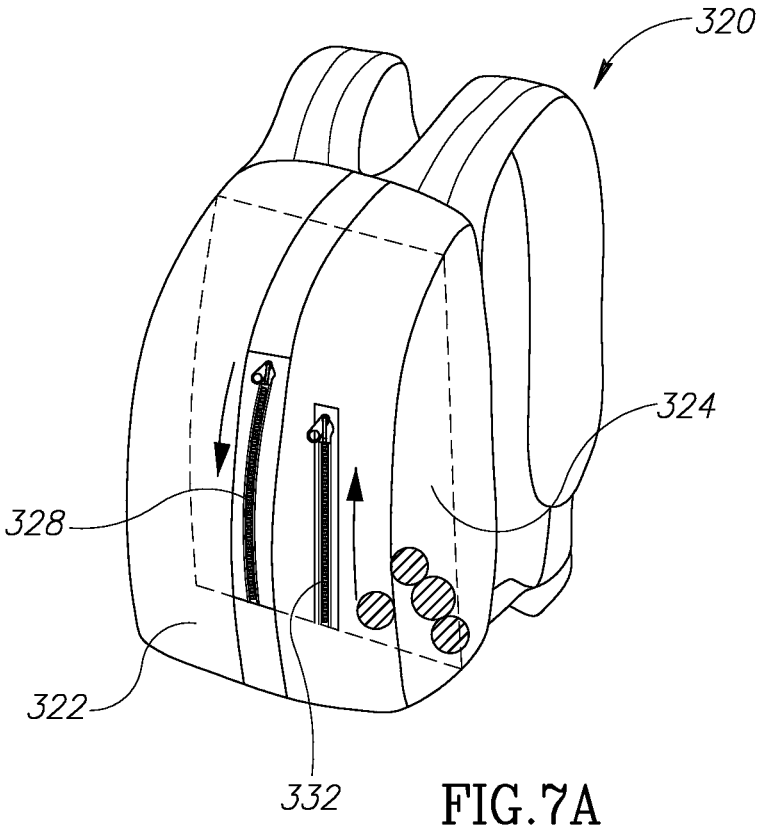
FIGS. 7A to 7F illustrate backpacks configured with different examples of zipper assemblies according to the disclosure.
Figure 7B:
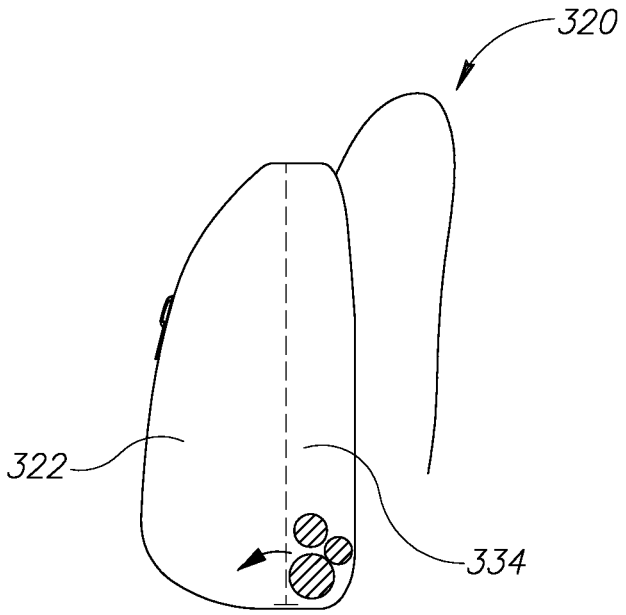

FIGS. 7A to 7F illustrate examples of employing a zipper system according to the present disclosure, in various combinations of a backpack. In FIGS. 7A and 7B the backpack 320 is configured with a main compartment 322 and a hidden compartment 324. The main compartment is accessible through a main zipped opening 328, and the hidden compartment 324 is accessible through a second zipped opening 332, however accessible only through the main zipped opening 328. The arrangement is such that the second zipped opening 332 is openable only upon opening the main zipped opening 328, wherein the two zippers cooperate as a zipper assembly according to the disclosure.

Figure 7C:
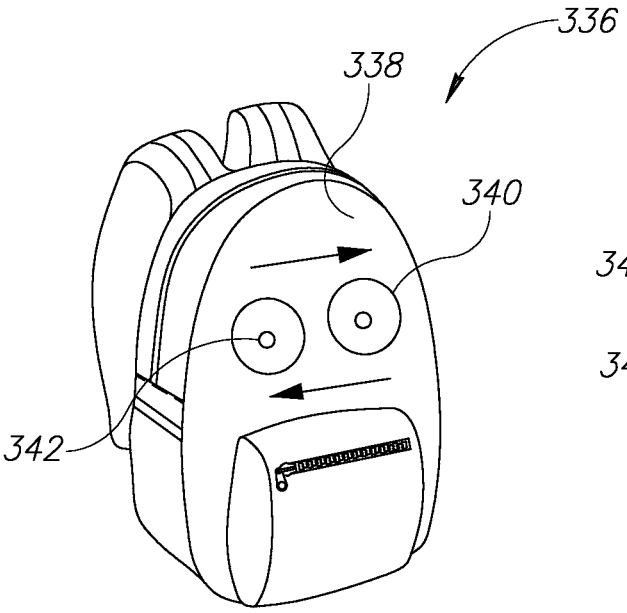
Figure 7D:
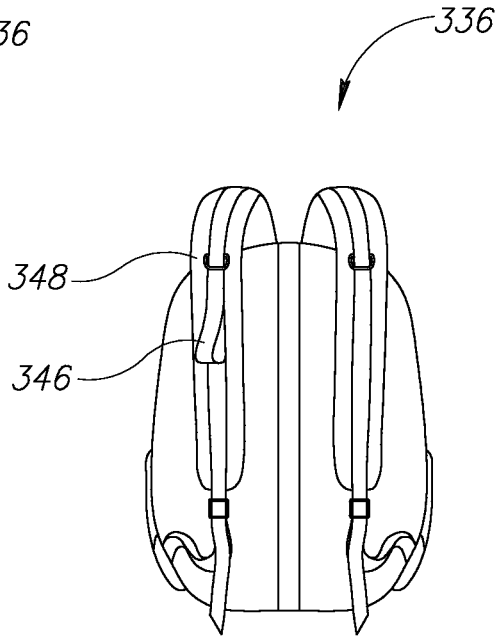

In FIGS. 7C and 7D there is illustrated a backpack generally designated 336 wherein a back wall 338 of the back pack is configured with two figurative eye-like elements 340 with movable pupils 342 therein. The pupils are articulated through a flexible cord (not seen) to a pulling tab 346 at a shoulder strap 348 of the backpack, cooperating as a zipper assembly according to the disclosure, wherein pulling the pull tab 346 entails rolling motion of the pupils 342 at an amusing fashion.

Figure 7E:
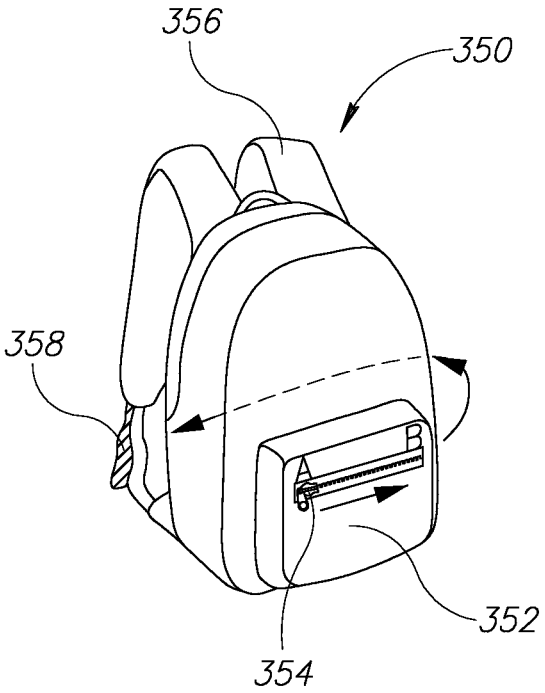
Figure 7F:
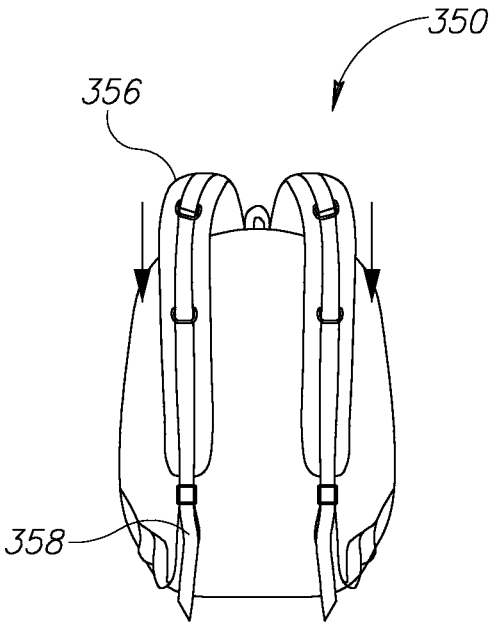

In FIGS. 7E and 7F there is illustrated yet a backpack 350, configured at a back portion thereof with a zipped compartment 352, wherein a the zipper slider 354 is associated with a flexible cable (not seen) extending towards a front portion of the backpack, through a shoulder strap 356, and terminating at pull tab 358, in accordance with the zipper assembly system disclosed herein, wherein pulling/pushing the pull tab 358 results in opening/closing the compartment 352, respectively.

Figure 8A:
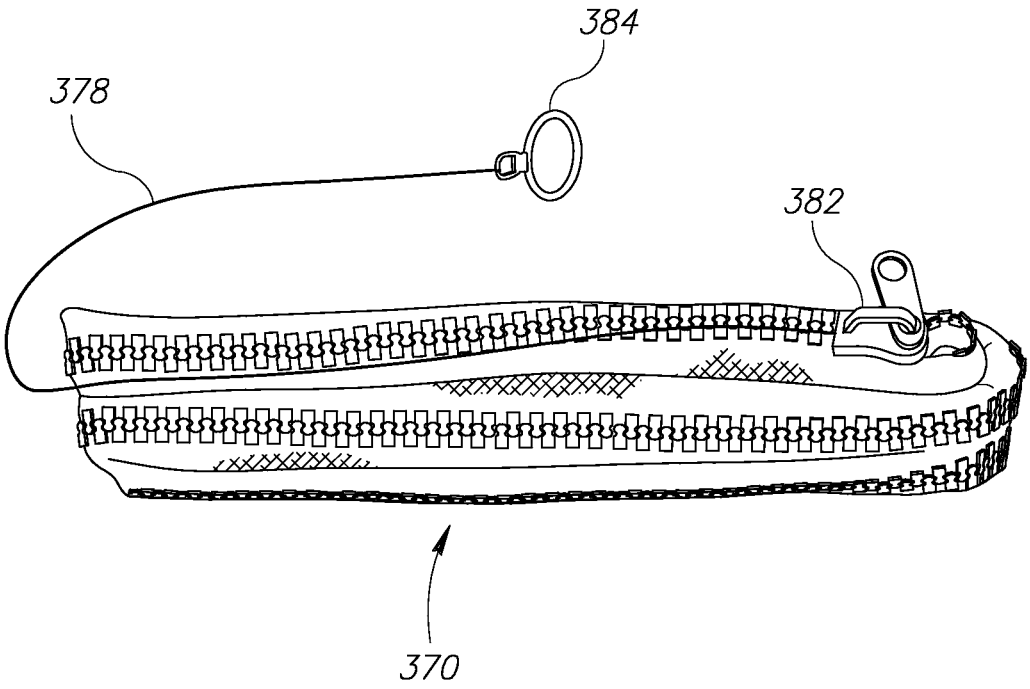
FIGS. 8A to 8E are consecutive steps of stripping a closed 3D object into a fully opened zipper strap.
Figure 8B:
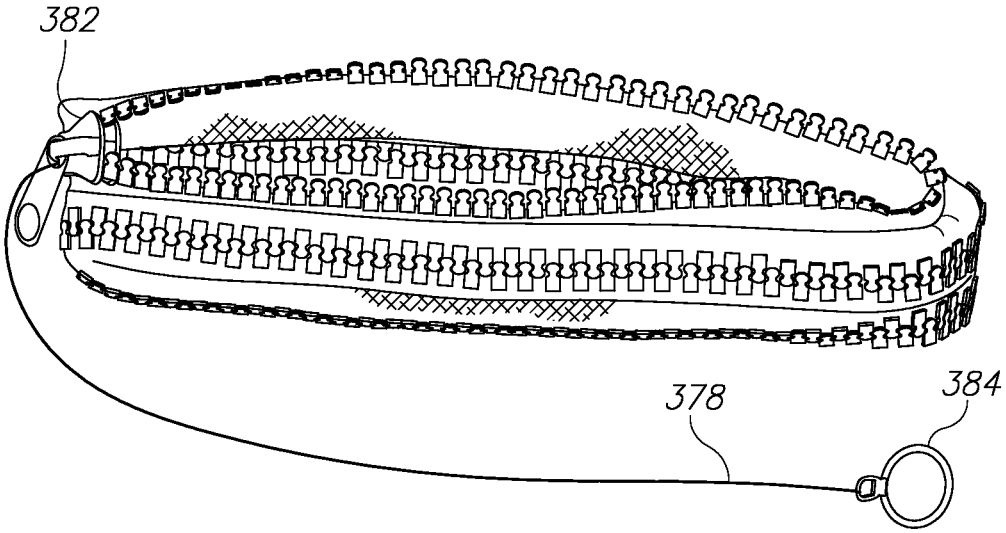
Figure 8C:
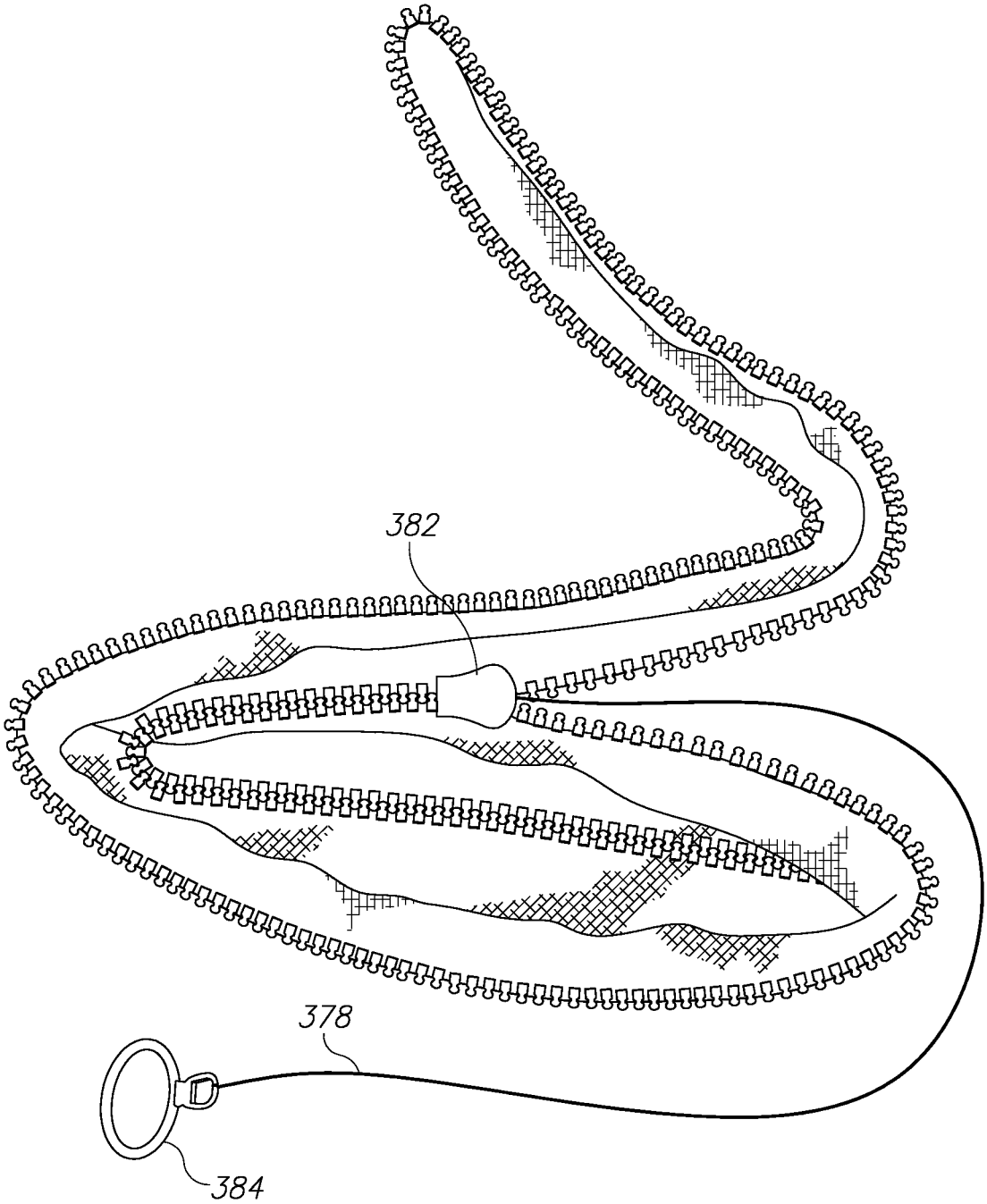
Figure 8D:
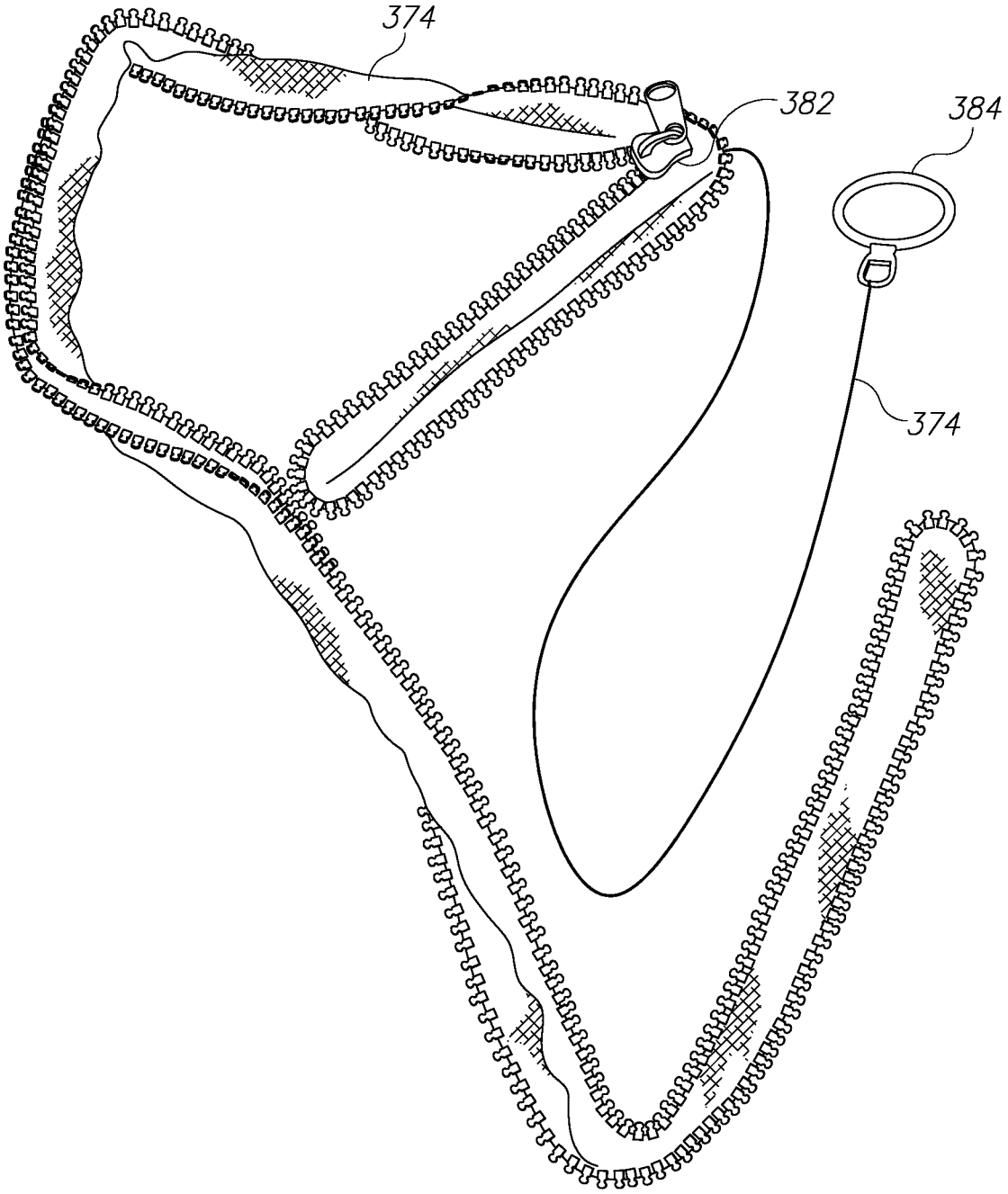
Figure 8E:
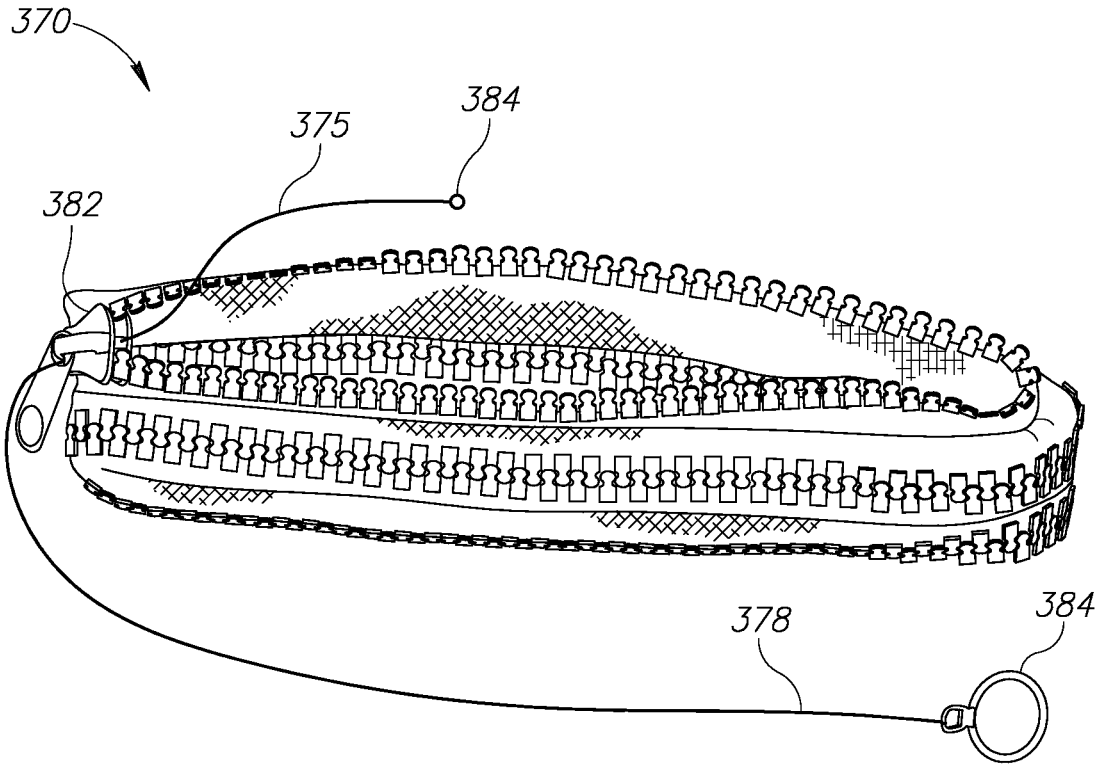

In FIGS. 8A to 8D there is illustrated a 3D element generally designated 370, useful for example as a pouch, purse, pencil case, etc., (seen at an erected, fully closed position in FIG. 8A). The element 370 is formed out of a continuous zipper strip 374 (seen at its fully stripped position in FIG. 8D), said zipped strip 374 zipper to itself along its length to give rise to the erect 3D pouch. The entire length of the zipper is configured with a raceway accommodating a flexible strip 378 extending there through, said flexible strip 378 having a first end 375 thereof articulated to the zipper slider 382, and terminating at a pull ring 384. The arrangement is such that the pouch 370 can be fully collapsed/opened (FIG. 8D), by pulling the flexible strip 378 outwardly, through pull ring 384. However, it is appreciated that the first end 375 of the flexible strip 378 is slidingly received within the zipper slider 382, whereby the slider can be manually displaced between a fully closed position (FIG. 8A) to a partially open position (FIG. 8B), wherein the first end 375 of the flexible strip 378 extends beyond the zipper slider 382 (FIG. 8E), without displacement of the pull ring 384.

Further attention is now directed to FIGS. 9 to 14, illustrating kinematics of several zipper assemblies according to several examples of the present disclosure. In the theses drawings, the following legend is used:

- a solid arrow represents motion of a governing/master member (i.e. a primary slider member);
- a dashed arrow represents reactionary motion of a slave member (secondary motion mechanism);
- the indication ZP represents a zipper path;
- a thick line represents a flexible strip/cord;

a square represents a primary slider member;

a triangle represents secondary motion e.g. a second slider member;

and a circle represents a retraction member.

Figure 9A:
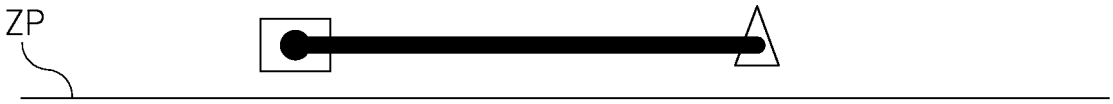
FIGS. 9A-9F, 10A-10D, 11A-11C, 12A-12C, 13A-13C and 14A to 14C are schematic illustrations, representing different modules of zipper assemblies according to the present disclosure, and their kinematics.

Turning first to FIGS. 9A to 9F, the following situations are exemplified:

In FIG. 9A the primary slider member and the slave member are at an initial, still position.

Figure 9B:
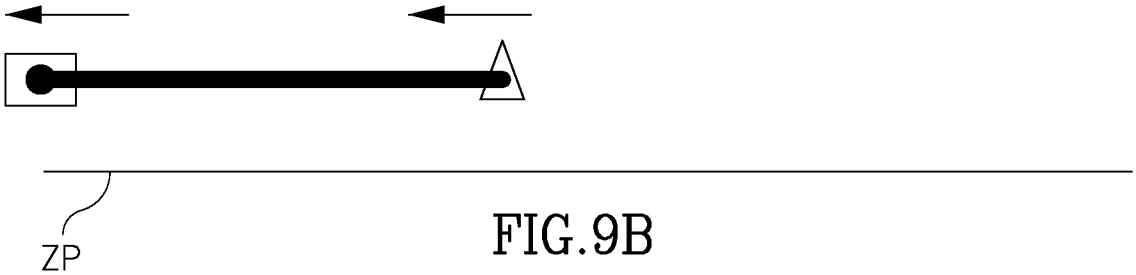

In FIG. 9B the primary slider member is displaced (left wise), resulting in corresponding (left wise) displacement of the slave member, being pulled.

Figure 9C:
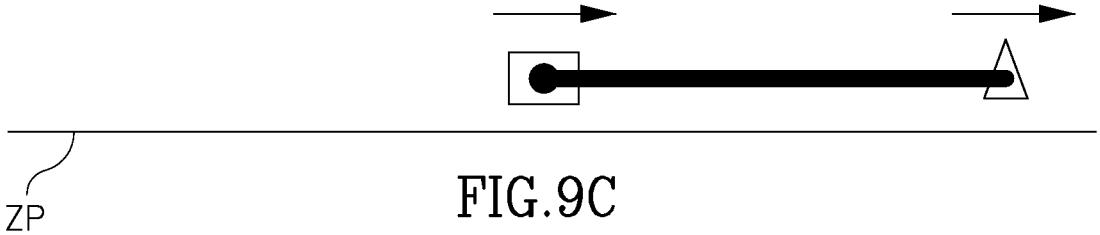

In FIG. 9C the slave member is displaced (right wise), resulting in corresponding (left wise) displacement of the primary slider member.

Figure 9D:
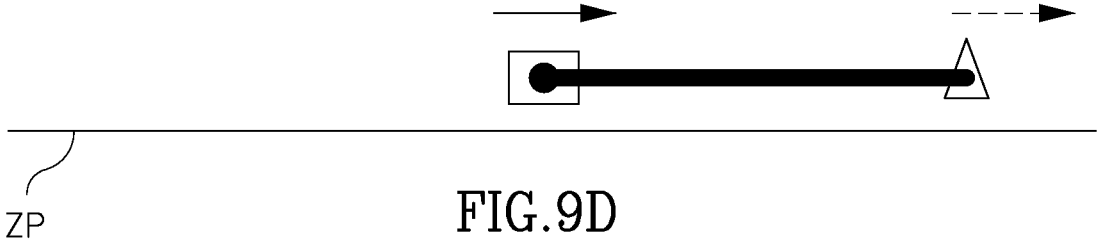
Figure 9E:
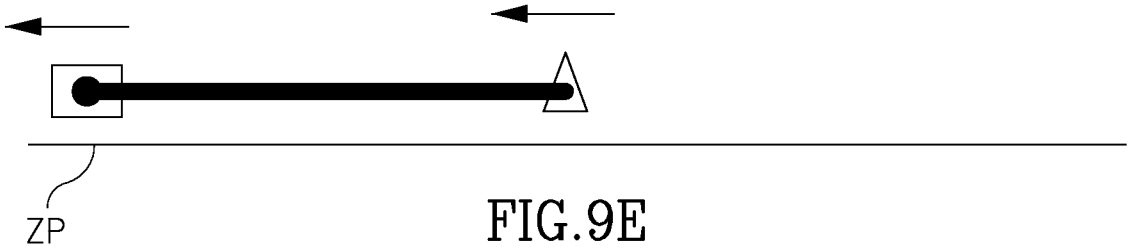

In FIG. 9D the primary slider member is displaced (right wise), resulting in corresponding (left wise) displacement of the slave member, being pushed.

Figure 9F:
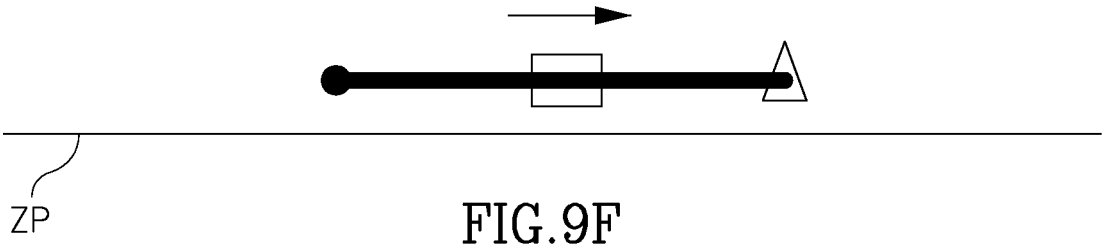

In FIG. 9F the slave member is displaced (left wise), resulting in corresponding (left wise) displacement of the primary slider member, being pushed.

In FIG. 9F the primary slider member is displaced right wise, however the slave member remains still as the first end of the flexible cord is not fixedly attached to the primary slider member.

Figure 10A:
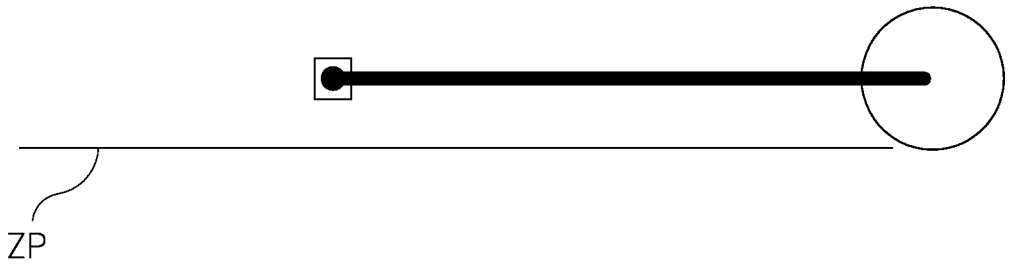

Turning now to FIGS. 10A to 10D, the following situations are exemplified:

In FIG. 10A the primary slider member is illustrated at an initial neutral position.

Figure 10B:
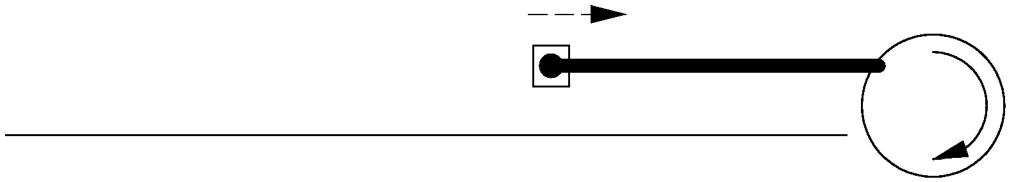

In FIG. 10B the retraction member is activated resulting in corresponding right wise linear displacement of the primary slider member.

Figure 10C:
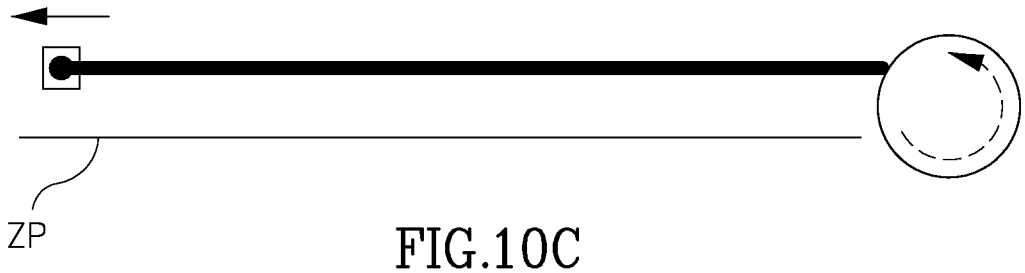

In FIG. 10C the primary slider member is displaced left wise, resulting in corresponding dispensing of the flexible cord from the retraction member.

Figure 10D:
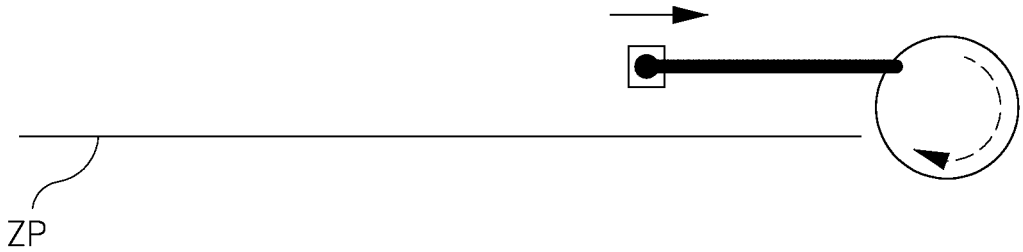

In FIG. 10D the primary slider member is displaced right wise, resulting in corresponding collecting of the flexible cord into the retraction member.

Figure 11A:
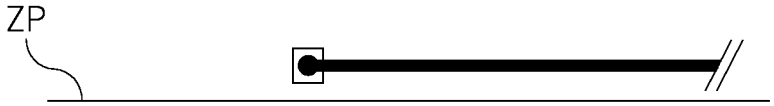
Figure 11B:
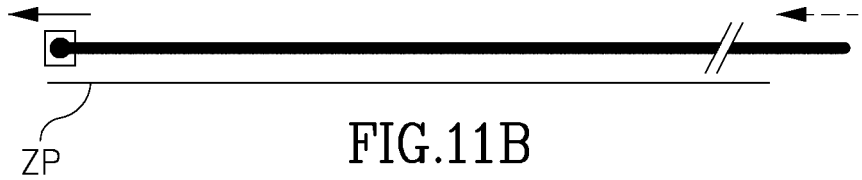
Figure 11C:
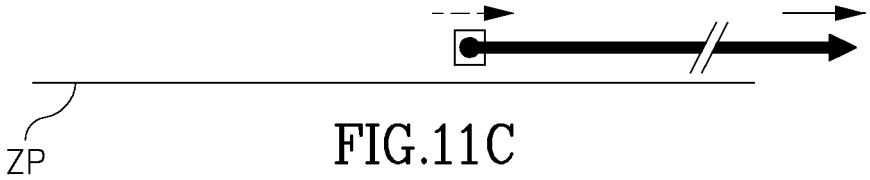

Turning now to FIGS. 11A to 11C, the following situations are exemplified:

In FIG. 11A the primary slider member is illustrated at an initial neutral position.

In FIG. 11B the primary slider member is displaced left wise, resulting in corresponding pulling (left wise) displacement of the second end of the flexible cord.

In FIG. 11C the second end of the flexible cord is pulled (right wise), resulting in corresponding displacement of the primary slider member right wise.

Figure 12A:
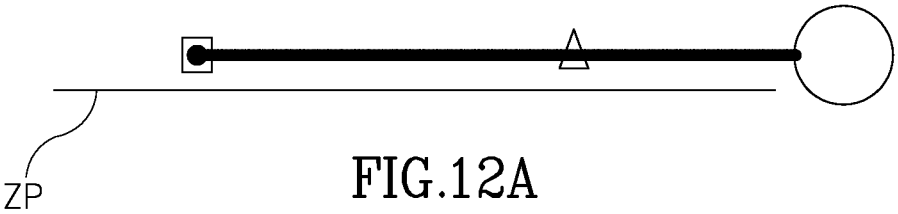
Figure 12B:
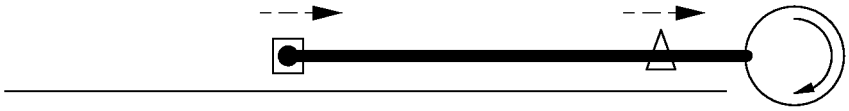
Figure 12C:
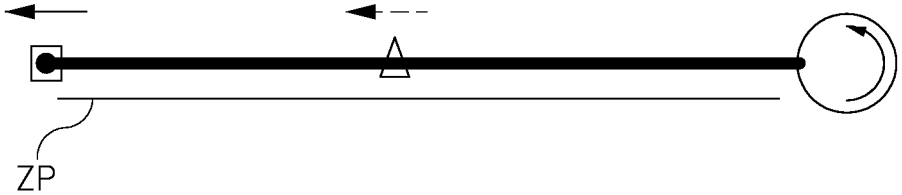

Turning now to FIGS. 12A to 12C, the following situations are exemplified:

In FIG. 12A the primary slider member and the slave member are at an initial, still position.

In FIG. 12B the retraction member is activated in a collecting fashion, resulting in corresponding right wise displacement of both the primary slider member and the slave member.

In FIG. 12C the primary slider member is displaced left wise, resulting in corresponding left wise dispensing of the slave member and corresponding dispensing of flexible strip through the retraction member.

Figure 13A:
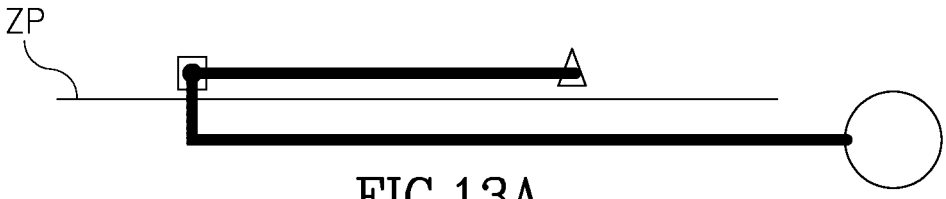

Turning now to FIGS. 12A to 13C, the following situations are exemplified, wherein the flexible cord extends also below the zipper path:

In FIG. 13A the primary slider member and the slave member are at an initial, still position.

Figure 13B:
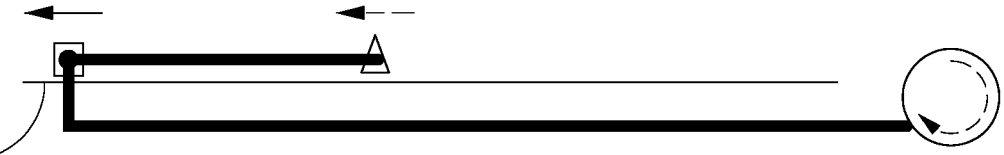

In FIG. 13B the primary slider member is displaced left wise, resulting in corresponding left wise dispensing of the slave member and corresponding dispensing of flexible strip through the retraction member.

Figure 13C:
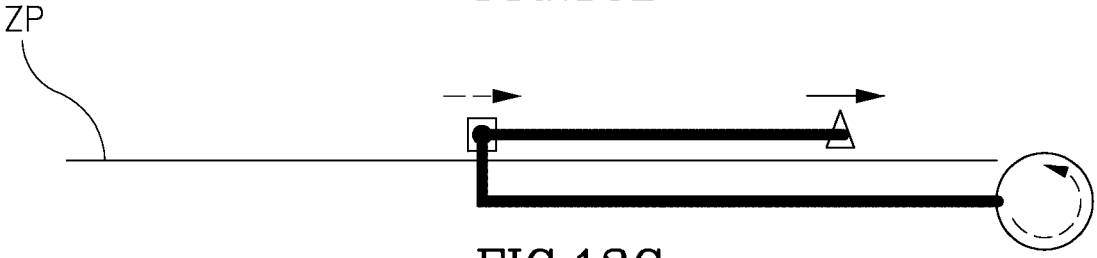

In FIG. 13C the slave member is displaced right wise, resulting in corresponding right wise dispensing of the primary slider member and corresponding collecting of flexible strip through the retraction member.

Figure 14A:
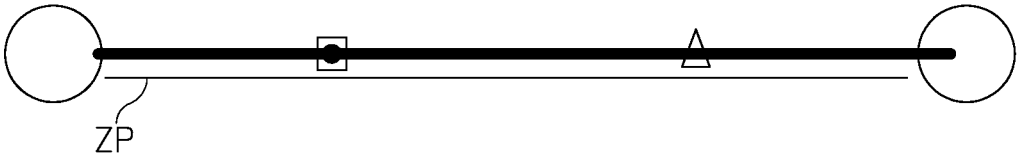
Figure 14B:
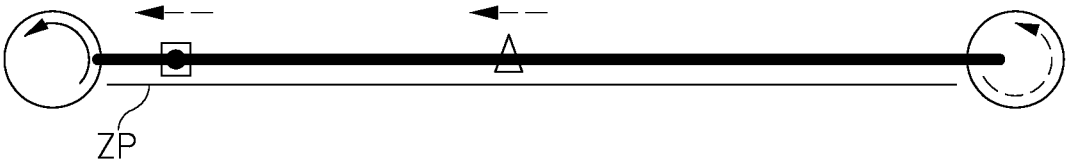
Figure 14C:
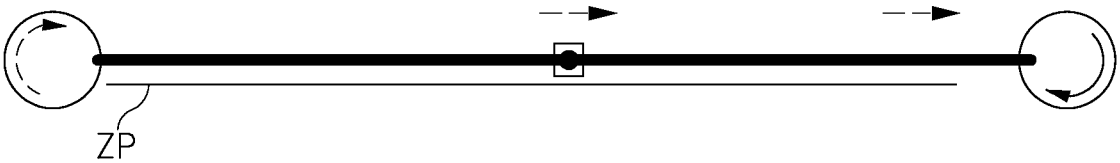

Turning now to FIGS. 14A to 14C, the following situations are exemplified, wherein two retraction members are disposed, each at a respective end of the flexible cord, extending outside of the zipper path:

In FIG. 14A the primary slider member and the slave member are at an initial, still position.

In FIG. 14B the left hand retraction member is activated in a sense so as to collect flexible cord, resulting in corresponding linear displacement of the primary slider member and the slave member, left wise, whilst the right hand collect member dispenses flexible cord.

In FIG. 14C the right hand retraction member is activated in a sense so as to collect flexible cord, resulting in corresponding linear displacement of the primary slider member and the slave member, right wise, whilst the left hand collect member dispenses flexible cord.

The invention claimed is:

1. A zipper assembly, comprising:

a left side tape configured with a plurality of left fastener teeth and a right side tape configured with a plurality of right fastener teeth, defining together a zipper path; and at least one primary slider member slidingly displaceable along the zipper path for interlocking engagement or disengagement of left fastener teeth with corresponding right fastener teeth, wherein at least a portion of the zipper path is configured with a raceway extending through alternating neighboring ones of the plurality of left fastener teeth and ones of the plurality of right fastener teeth, said raceway configured for slidingly accommodating a flexible strip articulated at a first end thereof to at least one slider member.

2. The zipper assembly according to claim 1, further comprising at least one secondary motion mechanism, wherein the flexible strip is articulated at the first end thereof to said at least one primary slider member and at a second end to said secondary motion mechanism; wherein displacement of one of the at least one primary slider member or the secondary motion mechanism entails reactionary motion of at least the other one of the at least one primary slider member or the secondary motion mechanism.

3. The zipper assembly according to claim 2, wherein the second end of the flexible strip extends within or outside the zipper path.

4. The zipper assembly according to claim 2, wherein the second end of the flexible strip is articulated to a manipulating device configured for pulling/pushing the flexible strip through the raceway.

5. The zipper assembly according to claim 1, wherein the raceway extending through alternating neighboring ones of the plurality of left fastener teeth and ones of the plurality of right fastener teeth is configured by a plurality of coextending recesses formed in successive alternating left fastener teeth and mating right fastener teeth.

6. The zipper assembly according to claim 2, wherein the at least one primary slider member is displaceable only along the zipper path, whilst reactionary motion of the secondary motion mechanism is axial or rotary motion.

7. The zipper assembly according to claim 1, wherein the first end of the flexible strip member is fixedly articulated to a body portion of the at least one primary slider member.

8. The zipper assembly according to claim 2, wherein the first end of the flexible strip is slidingly articulated to a body portion of the at least one primary slider member, and wherein displacing the at least one primary slider member along the zipper path results in respective engagement or disengagement of left fastener teeth with corresponding right fastener teeth, however without displacing the flexible strip and therefore without effecting the secondary motion mechanism; and wherein displacing the secondary motion mechanism imparts linear motion to the flexible strip and to the primary slider member, respectively.

9. The zipper assembly according to claim 1, wherein the raceway is substantially symmetrically disposed along a central longitudinal axis of the zipper assembly.

10. The zipper assembly according to claim 1, wherein the raceway is configured to be closed when the zipper path is closed, and the raceway is configured to be open when the zipper path is open, respectively.

11. The zipper assembly according to claim 1, wherein the raceway extending through alternating neighboring ones of the plurality of left fastener teeth and ones of the plurality of right fastener teeth comprises a right raceway portion extending through consecutive ones of the right fastener teeth and a complementary left raceway portion, extending through consecutive ones of the left fastener teeth.

12. The zipper assembly according to claim 1, wherein the zipper assembly comprises two or more parallelly extending raceways, each slidingly accommodating a flexible strip; wherein each of the flexible strips act in the same direction or in opposite directions with consequent reactionary motion of the at least one primary slider member and a secondary motion mechanism.

13. The zipper assembly according to claim 1, wherein the right fastener teeth and the left fastener teeth constituting part of the raceway are configured with a substantially U-like shaped recess with an opening facing respective opposite fastener teeth.

14. The zipper assembly according to claim 1, wherein the zipper path comprises one or more segments, each associated with a primary slider member; the primary slider member of one of the one or more segments can be articulated to a primary slider member or to a secondary motion mechanism of another one of the one or more segments, through a flexible strip articulated thereto.

15. The zipper assembly according to claim 1, wherein the at least one primary slider member comprises a body member slidingly displaceable over the zipper path, said body member comprising a diamond element configured for separating engaged left fastener teeth from corresponding right fastener teeth, and wherein the flexible strip is articulated to said diamond element.

16. The zipper assembly according to claim 2, wherein the secondary motion mechanism is a second zipper slider of any type and disposed at either head to head or bottom to bottom relation with respect to the at least one primary slider member.

17. The zipper assembly according to claim 2, wherein the secondary motion mechanism is a retraction mechanism wherein the flexible strip is biased by the retraction mechanism to exert pulling force to the primary slider member.

18. The zipper assembly according to claim 2, wherein the secondary motion mechanism is associated with a cord retractor for reducing force required for displacing the flexible strip through the raceway.

19. The zipper assembly according to claim 18, wherein the cord retractor comprises a deployable flexible strip, which in turn is articulated directly to the primary slider member, or via a secondary motion mechanism.

20. The zipper assembly according to claim 2, wherein the secondary motion mechanism is a secondary slider member.

* * * * *